US008414073B2

(12) United States Patent
Schmitz et al.

(10) Patent No.: US 8,414,073 B2
(45) Date of Patent: Apr. 9, 2013

(54) SEATING ARRANGEMENT

(75) Inventors: Johann Burkhard Schmitz, Berlin (DE); Carola Eva Marianne Zwick, Berlin (DE); Roland Rolf Otto Zwick, Berlin (DE); Claudia Plikat, Berlin (DE)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 12/225,334

(22) PCT Filed: Mar. 22, 2007

(86) PCT No.: PCT/IB2007/000721

§ 371 (c)(1),
(2), (4) Date: Sep. 18, 2008

(87) PCT Pub. No.: WO2007/110729

PCT Pub. Date: Oct. 4, 2007

(65) Prior Publication Data

US 2010/0289308 A1 Nov. 18, 2010

(30) Foreign Application Priority Data

| | | |
|---|---|---|
| Mar. 24, 2006 | (DE) | 10 2006 014 109 |
| Apr. 26, 2006 | (DE) | 10 2006 020 006 |
| Apr. 26, 2006 | (DE) | 10 2006 020 007 |
| Jul. 21, 2006 | (DE) | 10 2006 034 307 |
| Jul. 27, 2006 | (DE) | 10 2006 035 553 |
| Aug. 24, 2006 | (DE) | 10 2006 039 606 |

(51) Int. Cl.
*A47C 1/024* (2006.01)

(52) U.S. Cl.
USPC ..... 297/321; 297/302.1

(58) Field of Classification Search ..... 297/302.1, 297/321
See application file for complete search history.

(56) References Cited

U.S. PATENT DOCUMENTS

| | | | |
|---|---|---|---|
| 946,225 | A | 1/1910 | Irwin |
| 2,771,122 | A | 11/1956 | Straub |
| 3,041,109 | A | 6/1962 | Eames et al. |
| 3,120,407 | A | 2/1964 | Propst |
| 3,230,011 | A | 1/1966 | Propst |
| 3,300,251 | A | 1/1967 | Helms |
| 3,565,482 | A | 2/1971 | Blodee |
| 3,586,370 | A | 6/1971 | Barecki et al. |

(Continued)

FOREIGN PATENT DOCUMENTS

| | | | |
|---|---|---|---|
| AU | 6563380 | A1 | 1/1983 |
| DE | 4433663 | A1 | 9/1996 |

(Continued)

OTHER PUBLICATIONS

Office Action from co-pending U.S. Appl. No. 12/284,159, dated Jun. 10, 2010, 10 pages.

(Continued)

*Primary Examiner* — Anthony D Barfield
(74) *Attorney, Agent, or Firm* — Brinks Hofer Gilson & Lione

(57) ABSTRACT

The invention relates to a seating arrangement (1) having a substructure (3), in which the seating arrangement (1) comprises at least one carrying arm (7, 8), and the carrying arm (7, 8) comprises an upper, first carrier (7*a*, 8*a*) and a lower, second carrier (7*b*, 8*b*).

31 Claims, 26 Drawing Sheets

U.S. PATENT DOCUMENTS

Figure 1A:
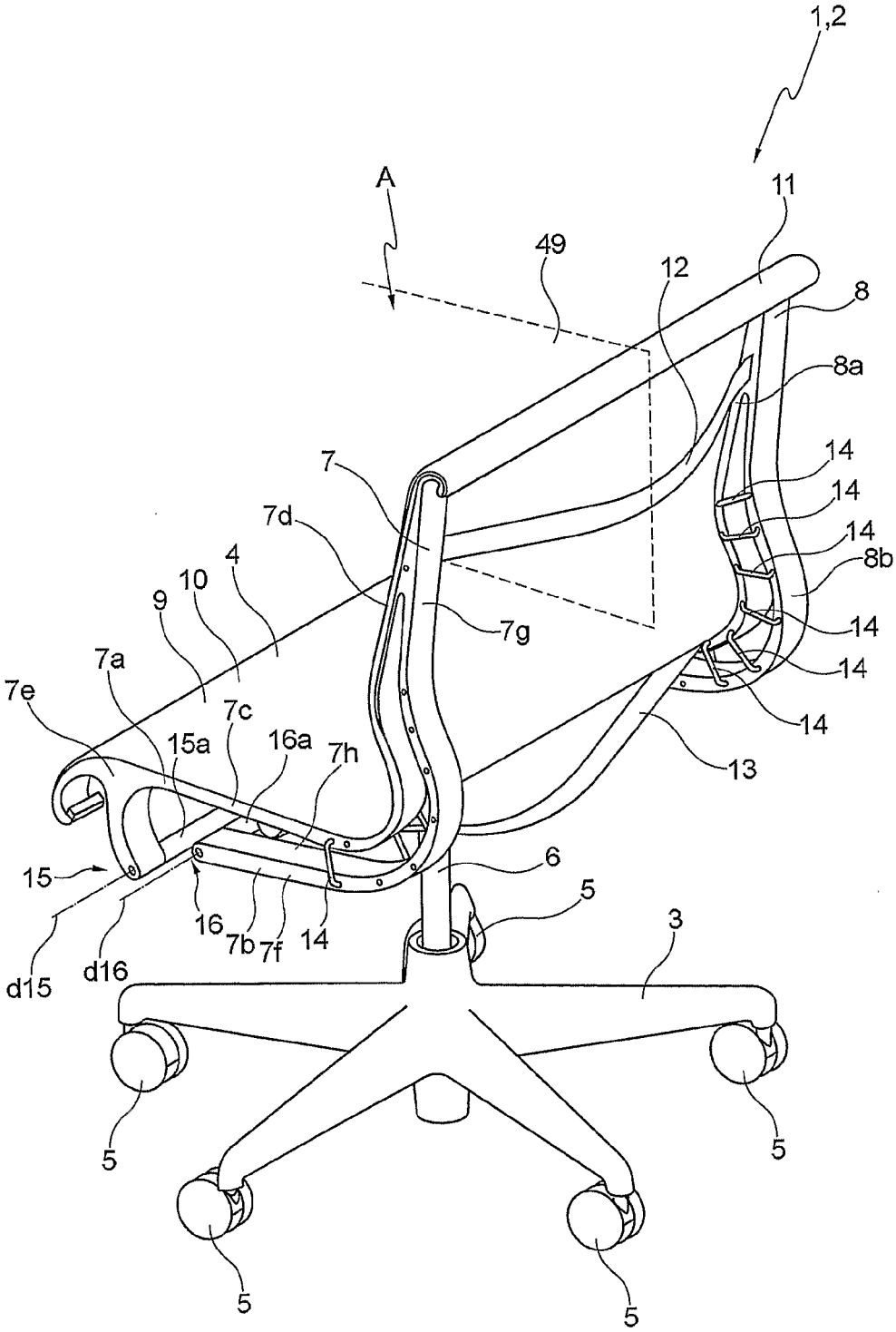

| | | | | |
|---|---|---|---|---|
| 3,640,576 | A | | 2/1972 | Morrison et al. |
| 3,669,496 | A | | 6/1972 | Chisholm |
| 3,844,612 | A | | 10/1974 | Borggren |
| 3,877,750 | A | | 4/1975 | Scholpp |
| D235,298 | S | | 6/1975 | Schuyler |
| 4,036,527 | A | | 7/1977 | Faul |
| 4,062,590 | A | | 12/1977 | Polsky et al. |
| 4,230,365 | A | | 10/1980 | Messinger |
| 4,522,444 | A | | 6/1985 | Pollock |
| 4,529,247 | A | | 7/1985 | Stumpf et al. |
| 4,585,272 | A | | 4/1986 | Ballarini |
| 4,592,126 | A | | 6/1986 | Bottemiller |
| 4,889,385 | A | | 12/1989 | Chadwick et al. |
| 4,913,493 | A | | 4/1990 | Heidmann |
| 4,988,145 | A | * | 1/1991 | Engel ..... 297/321 X |
| 5,015,038 | A | | 5/1991 | Mrotz, III |
| 5,029,942 | A | | 7/1991 | Rink |
| D320,034 | S | | 9/1991 | Brooks et al. |
| 5,102,196 | A | | 4/1992 | Kaneda et al. |
| 5,114,210 | A | | 5/1992 | Naess |
| 5,240,308 | A | | 8/1993 | Goldstein |
| 5,320,410 | A | | 6/1994 | Faiks et al. |
| 5,328,245 | A | | 7/1994 | Marks |
| 5,352,022 | A | | 10/1994 | Knoblock |
| 5,518,294 | A | | 5/1996 | Ligon, Sr. et al. |
| D377,431 | S | | 1/1997 | Stumpf et al. |
| 5,649,743 | A | | 7/1997 | Skalka |
| 5,660,439 | A | | 8/1997 | Unwala |
| 5,664,835 | A | | 9/1997 | Desanta |
| D386,023 | S | | 11/1997 | Stumpf et al. |
| D390,026 | S | | 2/1998 | Biecher |
| 5,842,264 | A | | 12/1998 | Roossien et al. |
| 5,918,935 | A | | 7/1999 | Stulik et al. |
| 5,954,399 | A | | 9/1999 | Hong |
| 5,975,634 | A | | 11/1999 | Knoblock et al. |
| 6,015,187 | A | | 1/2000 | Roslund, Jr. et al. |
| 6,059,368 | A | | 5/2000 | Stumpf et al. |
| D436,259 | S | | 1/2001 | Nagamitsu |
| D436,260 | S | | 1/2001 | Nagamitsu |
| D437,132 | S | | 2/2001 | Nagamitsu |
| 6,193,318 | B1 | | 2/2001 | Becker et al. |
| D441,977 | S | | 5/2001 | Vaaler |
| D442,383 | S | | 5/2001 | Bell |
| 6,234,573 | B1 | | 5/2001 | Röder et al. |
| D444,309 | S | | 7/2001 | Nagamitsu |
| 6,257,665 | B1 | | 7/2001 | Nagamitsu et al. |
| D465,347 | S | | 11/2002 | Bell |
| 6,505,890 | B2 | | 1/2003 | Riley et al. |
| D469,618 | S | | 2/2003 | Nagamitsu |
| D469,970 | S | | 2/2003 | Molteni |
| 6,513,874 | B1 | | 2/2003 | Sander et al. |
| 6,572,190 | B2 | | 6/2003 | Koepke et al. |
| 6,582,190 | B2 | | 6/2003 | Jinnai |
| D476,493 | S | | 7/2003 | Nagamitsu |
| D476,820 | S | | 7/2003 | Nagamitsu |
| 6,609,754 | B2 | | 8/2003 | Rajasingham |
| D481,560 | S | | 11/2003 | Vidmar et al. |
| D482,542 | S | | 11/2003 | Pluer |
| D487,359 | S | | 3/2004 | Giugiaro |
| D489,542 | S | | 5/2004 | Giugiaro |
| 6,749,261 | B2 | | 6/2004 | Peterson et al. |
| 6,820,933 | B2 | | 11/2004 | Fereira Da Silva |
| 6,896,328 | B2 | | 5/2005 | Goodworth |
| D509,969 | S | | 9/2005 | Loew et al. |
| D511,629 | S | | 11/2005 | Caldwell |
| D512,578 | S | | 12/2005 | Igarashi |
| D512,579 | S | | 12/2005 | Igarashi |
| D513,910 | S | | 1/2006 | Gehry |
| 6,986,549 | B2 | | 1/2006 | Kniese |
| 6,991,291 | B2 | | 1/2006 | Knoblock et al. |
| D514,345 | S | | 2/2006 | Igarashi |
| D514,838 | S | | 2/2006 | Igarashi |
| D526,495 | S | | 8/2006 | Albin |
| 7,097,249 | B2 | | 8/2006 | Igarashi et al. |
| D527,920 | S | | 9/2006 | Giugiaro |
| D528,810 | S | | 9/2006 | Giugiaro |
| D528,811 | S | | 9/2006 | Giugiaro |
| D528,812 | S | | 9/2006 | Giugiaro |
| D540,557 | S | | 4/2007 | Doughty |
| D542,549 | S | | 5/2007 | Hara |
| D542,580 | S | | 5/2007 | Loew et al. |
| D543,039 | S | | 5/2007 | Hara |
| D543,040 | S | | 5/2007 | Hara |
| D543,041 | S | | 5/2007 | Hara |
| D543,042 | S | | 5/2007 | Hara |
| D543,369 | S | | 5/2007 | Hara |
| D543,371 | S | | 5/2007 | Wang |
| D543,385 | S | | 5/2007 | Loew et al. |
| D543,397 | S | | 5/2007 | Loew et al. |
| D543,736 | S | | 6/2007 | Shields |
| 7,226,127 | B1 | | 6/2007 | Yevko et al. |
| 7,243,993 | B2 | | 7/2007 | Igarashi et al. |
| 7,252,336 | B2 | | 8/2007 | Frisina |
| D550,471 | S | | 9/2007 | Igarashi |
| D550,977 | S | | 9/2007 | Igarashi |
| D552,368 | S | | 10/2007 | Scheper et al. |
| D552,882 | S | | 10/2007 | Saotome |
| D554,384 | S | | 11/2007 | Scheper et al. |
| D555,924 | S | | 11/2007 | Igarashi |
| D557,921 | S | | 12/2007 | Kane |
| D559,000 | S | | 1/2008 | Vanderminden, Sr. |
| 7,320,503 | B2 | | 1/2008 | Eysing |
| D572,915 | S | | 7/2008 | Doughty |
| D573,816 | S | | 7/2008 | Muller |
| 7,455,365 | B2 | | 11/2008 | Caruso et al. |
| 7,648,201 | B2 | | 1/2010 | Eysing |
| 2003/0189367 | A1 | | 10/2003 | Erker |
| 2004/0032156 | A1 | | 2/2004 | Stipek |
| 2006/0181126 | A1 | | 8/2006 | Eysing |
| 2006/0238009 | A1 | | 10/2006 | Igarashi et al. |
| 2006/0244295 | A1 | | 11/2006 | Igarashi et al. |
| 2008/0264425 | A1 | | 10/2008 | Mundell |
| 2009/0042014 | A1 | | 2/2009 | Synnestvedt et al. |

FOREIGN PATENT DOCUMENTS

| | | | |
|---|---|---|---|
| DE | 19916411 | A1 | 11/2000 |
| EP | 049310 | B1 | 3/1985 |
| EP | 00250109 | A1 | 12/1987 |
| EP | 860355 | A1 | 8/1998 |
| EP | 1040999 | A2 | 10/2000 |
| EP | 1316651 | A2 | 6/2003 |
| FR | 2715124 | A1 | 7/1995 |
| JP | D1284784 | | 10/2006 |
| LU | 88528 | A1 | 3/1996 |
| WO | WO 2007/110737 | A2 | 10/2007 |
| WO | WO 2009/039231 | A2 | 3/2009 |

OTHER PUBLICATIONS

Office Action from co-pending U.S. Appl. No. 12/225,335, dated Sep. 21, 2010, 7 pages.

International Search Report for International Application No. PCT/US2008/076768, dated Mar. 10, 2009, 3 pages.

Written Opinion of the International Searching Authority for International Application No. PCT/US2008/076768, dated Mar. 10, 2009, 7 pages.

Faraday, "Exploring Biomimetrics for Products & Packaging," Sep. 27, 2007, 3 pages.

Herman Miller for Business, "Eames Aluminum Group & Soft Pad Chairs," [online][retrieved from internet: URL http://www.hermanmiller.com/CDA/SSA/Product/1,1592,a10-c440-p39,00.html], [retrieved—date unknown], 2 pages.

International Search Report in International Application No. PCT/IB07/00721, dated Sep. 5, 2008, 3 pages.

International Search Report in International Application No. PCT/IB07/00745, dated Jul. 17, 2008, 2 pages.

Md, Magazine of Design, 5 pages, Oct. 2006.

Okamura Corporation, "Baron Ergonomic Mesh Chair," copyright 2005, [online][retrieved from internet: URL: http://www.okamura.co.jp/english/product/office/baron/index.html], [retrieved on Mar. 31, 2008], 1 page.

U.S. Appl. No. 29/291,968, filed Sep. 21, 2007, Schmitz et al. as filed, 50 pages.

United States Patent and Trademark Office, Trademark, Principal Register, Reg. No. 3,105,591, registered Jun. 20, 2006, 1 page.

U.S. Appl. No. 12/284,159, filed Sep. 18, 2008 , Schmitz et al. as filed, 125 pages.
U.S. Appl. No. 12/225,335, filed Mar. 22, 2007 , Schmitz et al. as filed, 53 pages.
Written Opinion in International Application No. PCT/IB07/00721, filed Sep. 5, 2008, 6 pages.
Written Opinion in International Application No. PCT/IB07/00745, dated Jul. 17, 2008, 4 pages.
International Search Report in International Application No. PCT/US08/76768, dated Mar. 10, 2009, 1 page.

* cited by examiner

SEATING ARRANGEMENT

The invention relates to a seating arrangement according to the preamble of claim 1.

DE 44 33 663 A1 discloses a chair which has two seat panels arranged one above the other, the upper seat panel being supported in relation to the lower seat panel at the level of the lumbar vertebra by means of a flexurally elastic plate. Such a chair reacts very sensitively to shifting of the upper part of the body since the two seat panels act like a flat-spring assembly, the chair tends to tilt resiliently when an individual leans back in it. As a result of this design, the substructure of the chair is subjected to pronounced loading and has to be dimensioned correspondingly.

U.S. Pat. No. 6,986,549 B2 discloses a chair with a backrest which reacts to a force acting on it by changing its shape. This backrest is formed by two surfaces which are referred to as skins and have a multiplicity of articulations, mutually opposite articulations of the two skins being connected in each case by individual ribs. On account of its specific design, this backrest tries to adapt itself to every contour and only at its tip has a reaction force which counteracts deformation or movement. Without the ribs connecting them, the so-called skins, which form the surface of the backrest, rather than having any inherent stability, behave like a link chain comprising plates which are each connected by articulations. A chair backrest which is designed in such a way encourages a rounded-back posture and thus definitely does not result in a healthy posture.

EP 0 49 310 B1 discloses a seating arrangement for work purposes in which a single-piece seat shell, which forms a seat surface and a backrest, is articulated in a rotatable manner on a substructure and is guided, and supported resiliently, on the substructure by a rigid, curved supporting lever articulated in the region of the backrest. The disadvantage with such a seating arrangement for work purposes is the heavy mechanism which is necessary in order for the torque which is produced by the sitting individual via the rigid supporting lever to be intercepted at the substructure.

The object of the invention is to develop a seating arrangement in which a carrying arm both introduces into the substructure the forces and moments produced by a sitting individual and allows defined elastic adjustment of the opening angle between the seat surface and backrest when a seated individual leans back, the necessary opposing forces being produced, at least in part, in the carrying arm.

Taking the features of the preamble of claim 1 as the departure point, this object is achieved, for example and without limitation, by the characterizing features of claim 1. Advantageous and expedient developments are specified in the subclaims.

The seating arrangement according to the invention comprises a seat and a substructure, the seat having at least one carrying arm, which comprises at least one upper carrier and at least one lower carrier, of which the upwardly directed legs are connected to one another and the approximately horizontally running legs are connected to a substructure of the seating arrangement. In this case, between the connecting location of their upwardly directed legs and the articulation of the approximately horizontally running legs on the sub-structure, the carriers, which are located one above the other, are kept at a defined spacing apart from one another in at least one section by at least one mechanical linking member. As a result, in each position of the seating arrangement, opening up of the upper, first carrier and/or rotation of the upper, first carrier about the bearing of the latter on the substructure is counteracted by an opposing force which is produced in the first and second carriers and/or is transmitted via the first and/or second carrier. This makes it possible to provide a seating arrangement in which an individual sitting on the seating arrangement, as he/she leans back, experiences both a predeterminable inclination of the seat and synchronous opening of the seat surface and backrest of the seat. By virtue of the carrying arm being attached to the substructure, loading causes the upper carrier and the lower carrier to be displaced in opposite directions. This shearing movement of the carriers inevitably causes precise predeterminable elastic deformation of the carrying arms results in the seat surface and backrest executing a movement in which an angle of inclination $\gamma$ of the backrest increases to a more pronounced extent than an angle of inclination $\beta$ of the seat surface. Furthermore, the elastic deformation of the carrying arm counteracts a rotary movement of the carrying arm. The elastic deformation of the carrying arm takes place in the region of the at least one linking member and is brought about by the at least one linking member, which keeps the carriers at a defined spacing apart from one another along the contour of the carrying arm as far as the common, no longer displaceable end. The degree of elastic deformation is predetermined essentially by the shaping of the carriers, by the number of linking members and by the positioning of the linking members. Each linking member prevents the carriers from splaying apart and thus allows large forces to be transmitted via a small and loading-optimized component. The core of the invention is a seating arrangement which has the comfort of a highly developed office chair, but dispenses altogether with a mechanism, arranged between the substructure and the seat surface or backrest, for controlling the movement of the seat surface and backrest. Rather, the invention provides for cinematic synchronization in one or more components configured as a carrying arm. The carrying arm thus functions as a control member for controlling the opening and closing of the angle between the seat surface and the backrest and as a control member for controlling the inclination of the seat surface. The configuration of the carrying arm, in combination with the locations of attachment to the substructure and the arrangement of the linking members, provides for a seating arrangement having a defined cinematic motion. In particular, the seat and back have a defined repeatable motion relative to each other as the seating arrangement is moved between an upright position and a reclined position. The repeated cinematic motion is achieved through pivoting and bending of the carrying arm, which are controlled by the configuration of the carrying arm and the arrangement of the linking members. In this way, the seating arrangement behaves or moves in a defined, consistent way, and is not susceptible and does not react differently to point loads applied along different portions of the seat or back.

The invention makes provision for the first carrier and/or the second carrier to be formed in one piece. It is thus possible for the carriers to be produced easily and cost-effectively as castings or injection moldings.

Furthermore, the invention makes provision for the at least one linking member between the first and the second carriers to be arranged in a first transition region, in which the horizontal, first legs merge into the upwardly directed, second legs. The risk of deformation of the lower carrier is greatest in this region. Appropriate positioning of the linking member thus makes it possible for the carrier to be subjected to considerably higher loading.

The invention makes provision for at least two linking members to be arranged between the carriers of the carrying arm and for these linking members to be positioned in the first transition region. This makes it possible for the elastic deformation of the carrying arm, which is necessary for increasing an opening angle, to be kept to a low level in the individual sections of the carrying arm.

According to the invention, the first transition region extends over half the length of the seat surface and half the height of the backrest. Arranging linking members in this section also safeguards a carrier against increased loading.

The invention also provides for a linking member to be arranged in a second transition region, in which the upwardly directed, second legs are located opposite a cervical-vertebra region of an individual sitting on the seating arrangement. This makes it possible to realize a special head support, which is important, for example, if the seating arrangement according to the invention is used in vehicles and aircraft.

According to the invention, in the case of a seating arrangement with just one carrying arm, the carrying arm is to be arranged in a vertical plane which divides the seating arrangement in a mirror-symmetrical manner. It is thus possible to realize particularly lightweight and space-saving seating-arrangement designs.

In the case of two carrying arms being used for a seating arrangement, provision is also made for these carrying arms to be arranged in a mirror-symmetrical manner in relation to the vertical plane which divides the seating arrangement in a mirror-symmetrical manner. This largely ensures uniform loading of the carrying arms when the seating arrangement is in use.

The invention makes provision, in particular, for the linking member to be designed as a clamp. It is thus possible for the upper and lower carriers to be retained in a defined position in relation to one another by extremely straightforward means.

Integrally forming the clamps on the upper or lower carrier makes it possible to avoid additional components and assembly work.

The invention also makes provision for the entire carrying arm to be formed in one piece. Consequently, the production outlay can be further reduced and straightforward recycling of the carrying arm is possible.

Furthermore, the invention makes provision for the linking member to be fastened on the first and/or second carrier by means of a plug-in connection. This serves for efficient assembly and, in the case of a plug-in connection in relation to the two carriers, also allows linking members to be exchanged.

According to the invention, provision is made to arrange an elastic body in a tunnel which is formed between the first and the second carriers and the linking member or two linking members. The two carriers can be stabilized in relation to one another by this elastic body.

The invention makes provision for the upper carrier to be mounted in a rotatable or eccentrically rotatable manner, or counter to an elastic resistance, in the first bearing. Different bearing means and the specific design thereof make it possible to change the movement behavior of the seating arrangement in accordance with specific requirements.

According to the invention, provision is made for the lower carrier to be mounted in a rotatable or eccentrically rotatable manner, or counter to an elastic resistance, in the second bearing. Different bearing means and the specific design thereof likewise make it possible to change the movement behavior of the seating arrangement in accordance with specific requirements.

The invention also makes provision for the upper carrier of the carrying arm to be connected to the substructure via at least one lever or via a coupling mechanism. This makes it possible for a rotary movement and/or a lowering movement to be predetermined more precisely.

The invention provides a carrying arm which is formed by a left-hand upper carrier and a right-hand upper carrier and a lower carrier located between the two, the lower carrier being connected to the two upper carriers by mechanical linking members. Dividing the upper carrier in this way means that it is also possible for a seat which comprises just one carrying arm to bear a cover as a seat surface and backrest.

Furthermore, the invention makes provision for at least the upper carrier or at least the lower carrier to be additionally supported by a spring element or a spring mechanism against an inclining movement in a direction of rotation. This allows adaptation of spring behavior and of the opening behavior of the seat. A seat can thus be adapted to different requirements by straight forward means.

Provision is made, in particular, for a spring force of the spring mechanism to be adjusted in dependence on the weight to which the seat is subjected by an individual sitting in the upright position. The behavior of the seat can thus be optimally adapted automatically to very different individuals.

Furthermore, the invention provides for displacement of the approximately horizontal legs of the carriers of the carrying arm in opposite directions when the seat is subjected to loading and the carrying arm is rotated correspondingly. This makes it possible to use the desired elastic deformation of the carrying arm in the region of its linking members and to build up a force opposing the loading by the individual sitting on the seating arrangement.

In particular, provision is made for the parallel axes of rotation of the carriers to be arranged at a spacing apart from one another, the axis of rotation of the lower carrier being located above the axis of rotation of the upper carrier, and the axis of rotation of the lower carrier being offset laterally in relation to the axis of rotation of the upper carrier. This makes it possible to achieve the desired shearing movement of the carriers which, together with the linking members, controls the opening up of the carrying arm.

Further details of the invention are described in the drawing with reference to schematically illustrated exemplary embodiments.

Figure 1B:
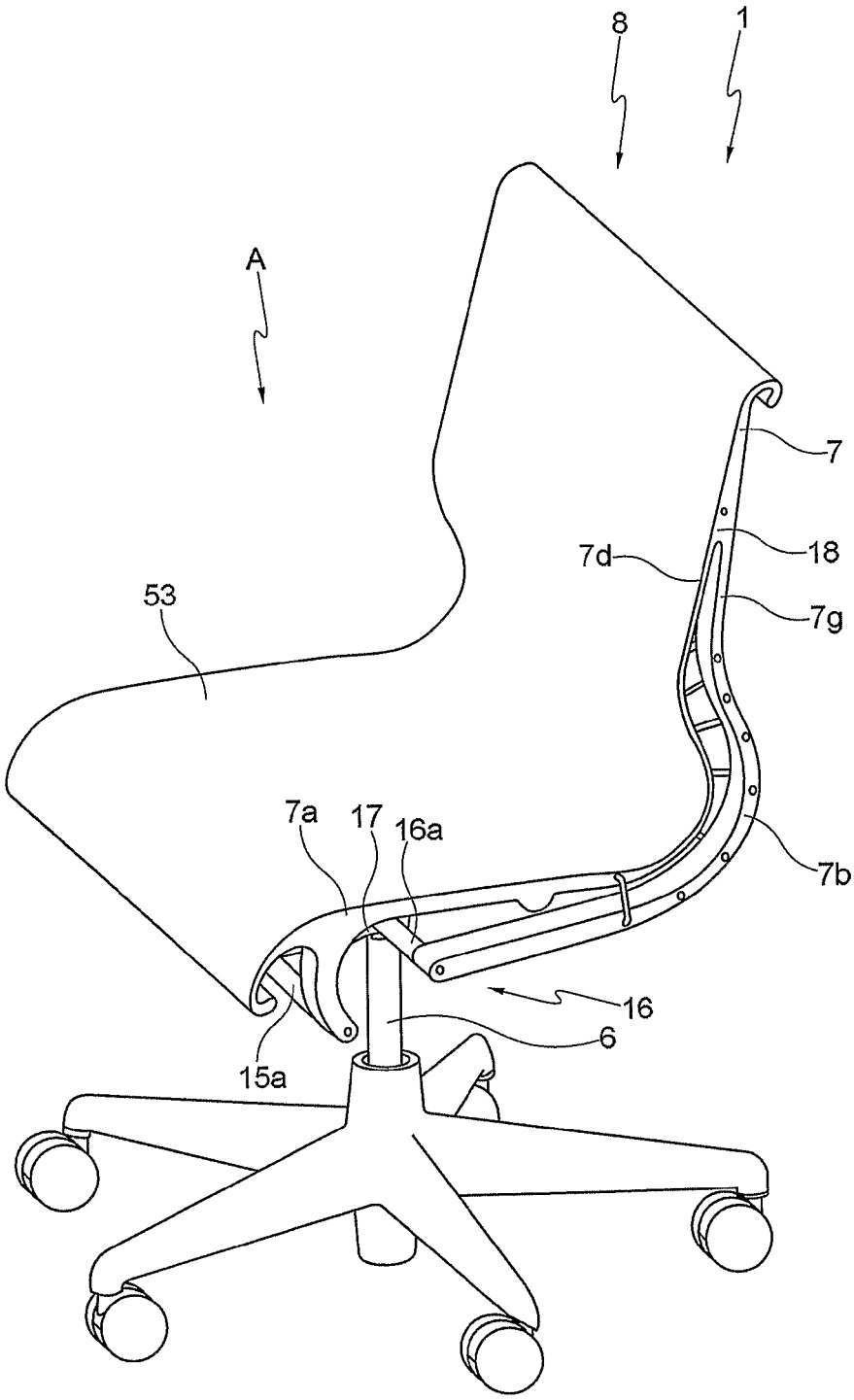
Figure 2A:
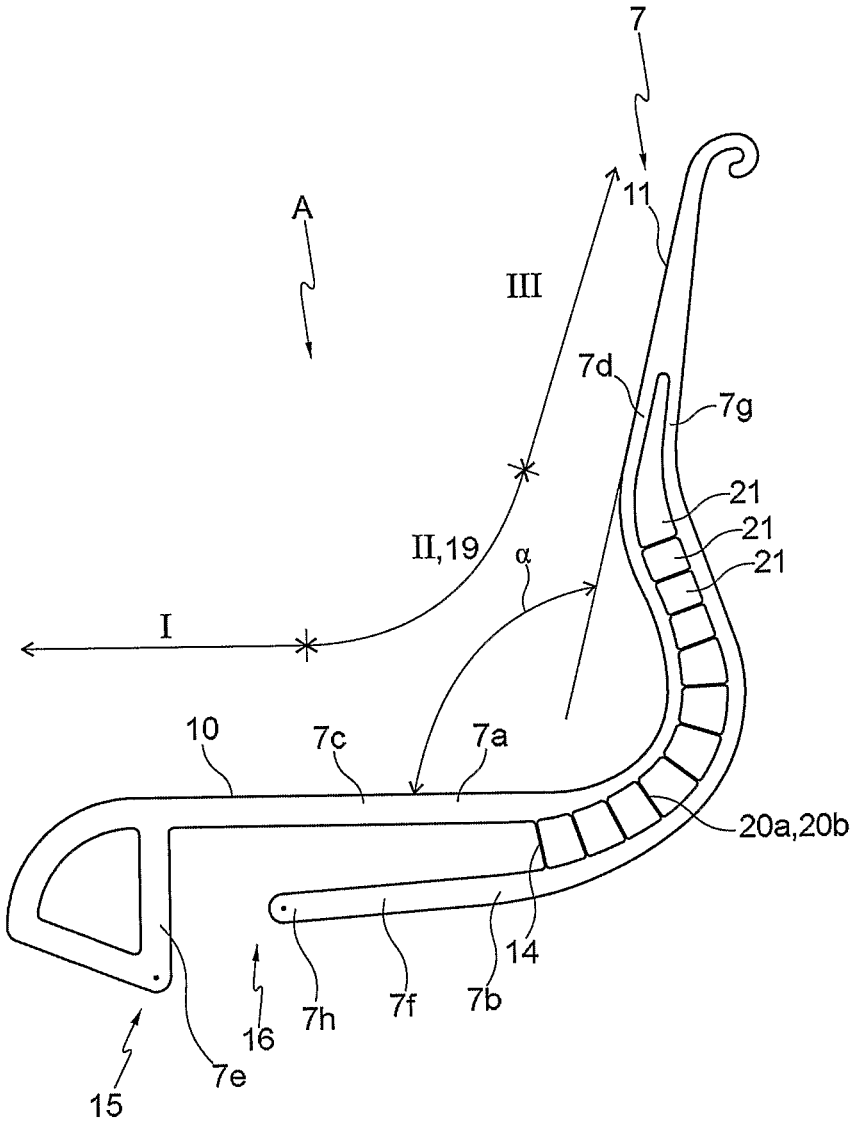
Figure 2B:
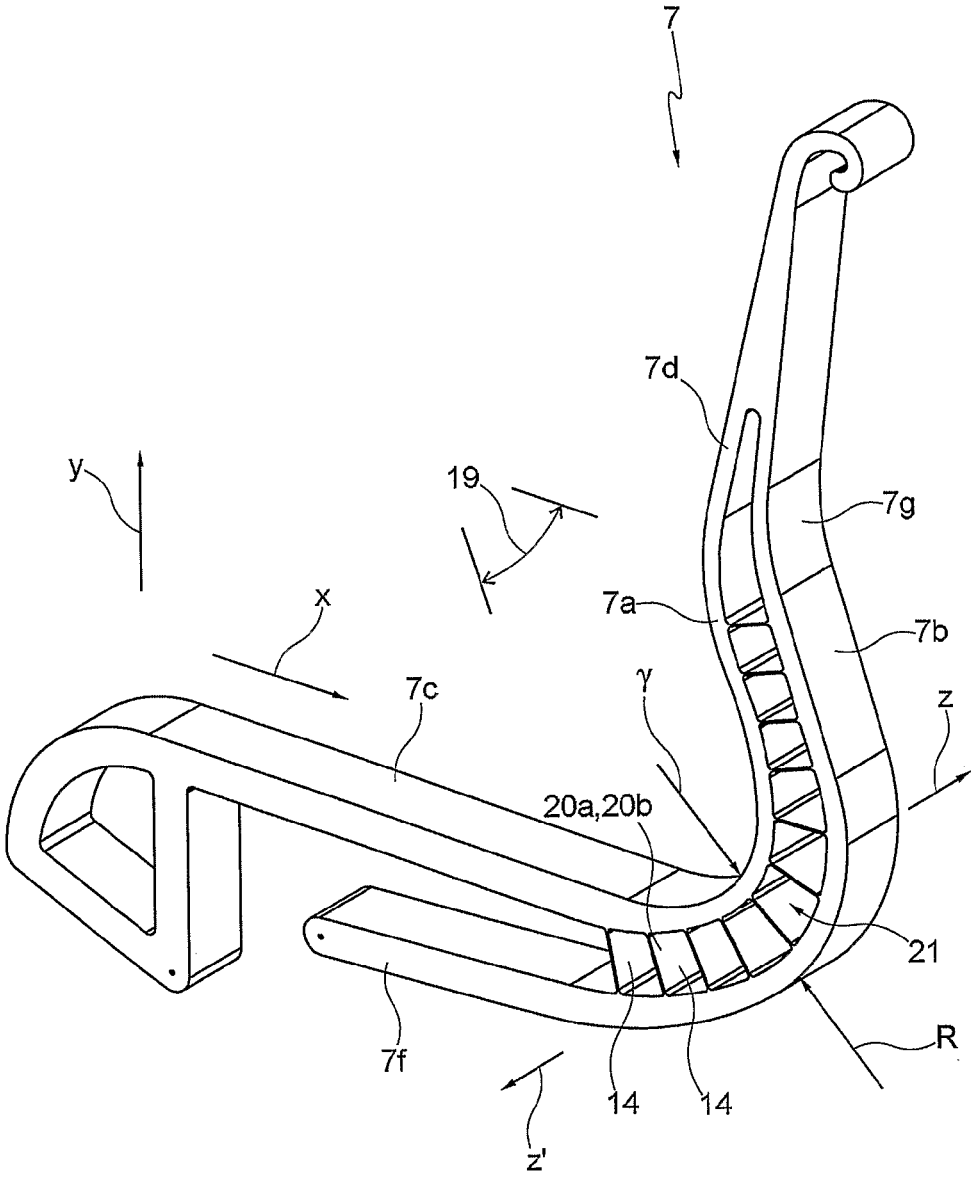

In the drawing:

FIGS. 1*a*, 1*b*: show perspective views of a first variant of a seating arrangement including a first variant of a carrying arm;

FIG. 2*a*: shows a side view of a second variant of a carrying arm;

FIG. 2*b*: shows a perspective view of the carrying arm which is shown in FIG. 2*a;*

Figure 4A:
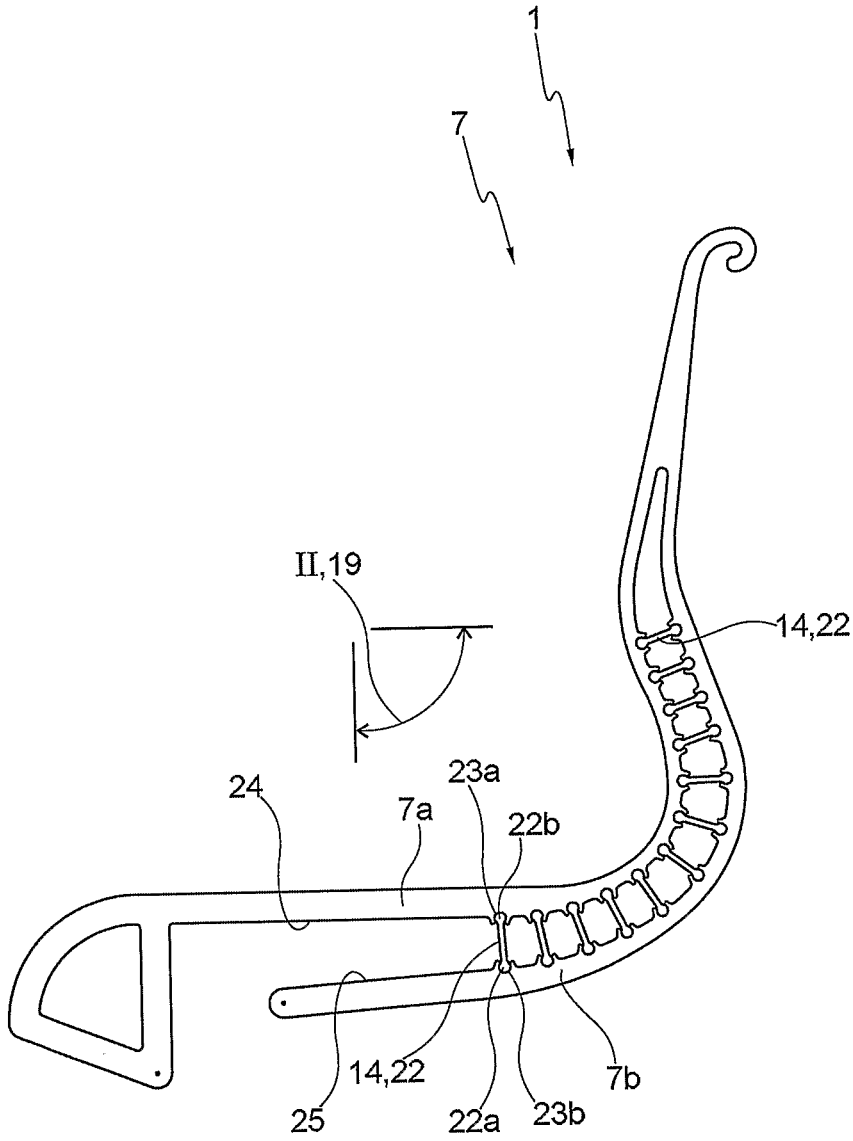
Figure 4B:
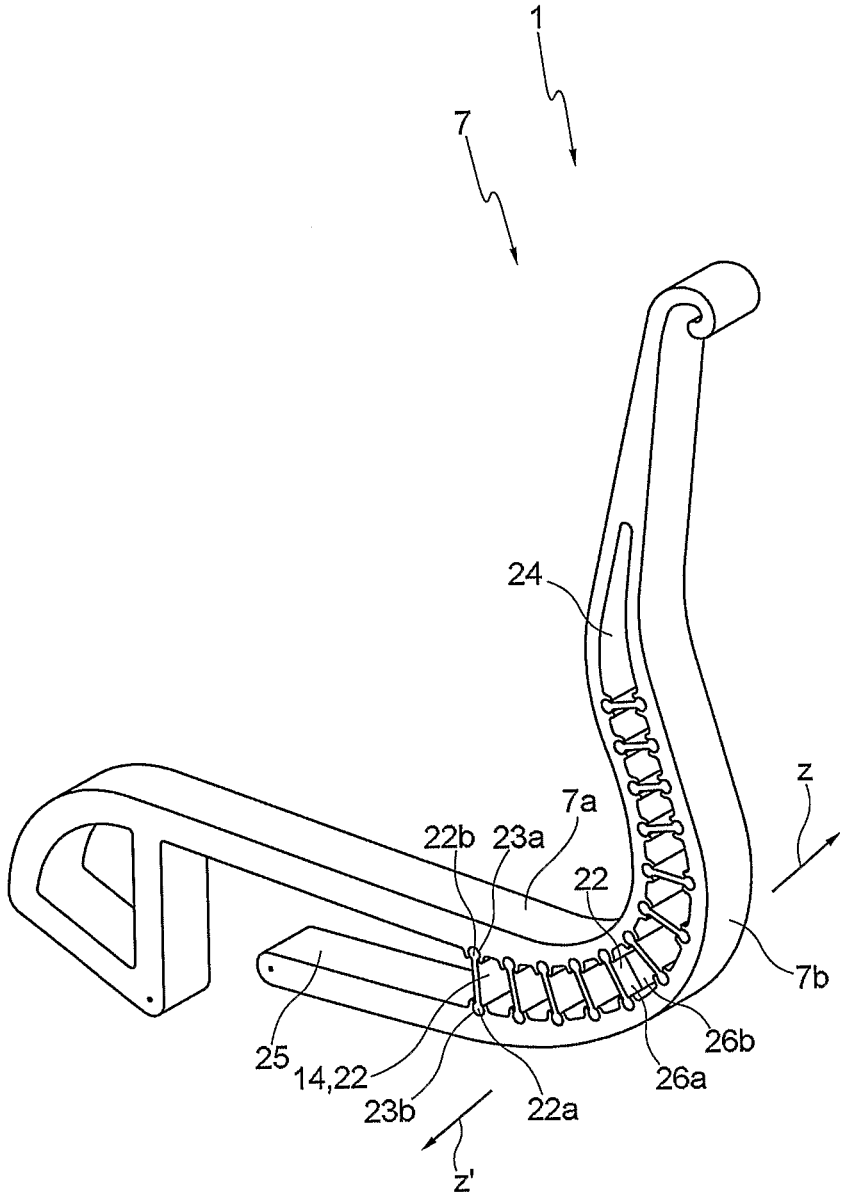

FIGS. 3*a*-3*d*: show four schematic views of a second variant of a carrying arm in four different positions which is similar to the first;

FIG. 4*a*: shows a side view of a third variant of a carrying arm;

FIG. 4*b*: shows a perspective view of the carrying arm which is shown in FIG. 4*a;*

Figure 5A:
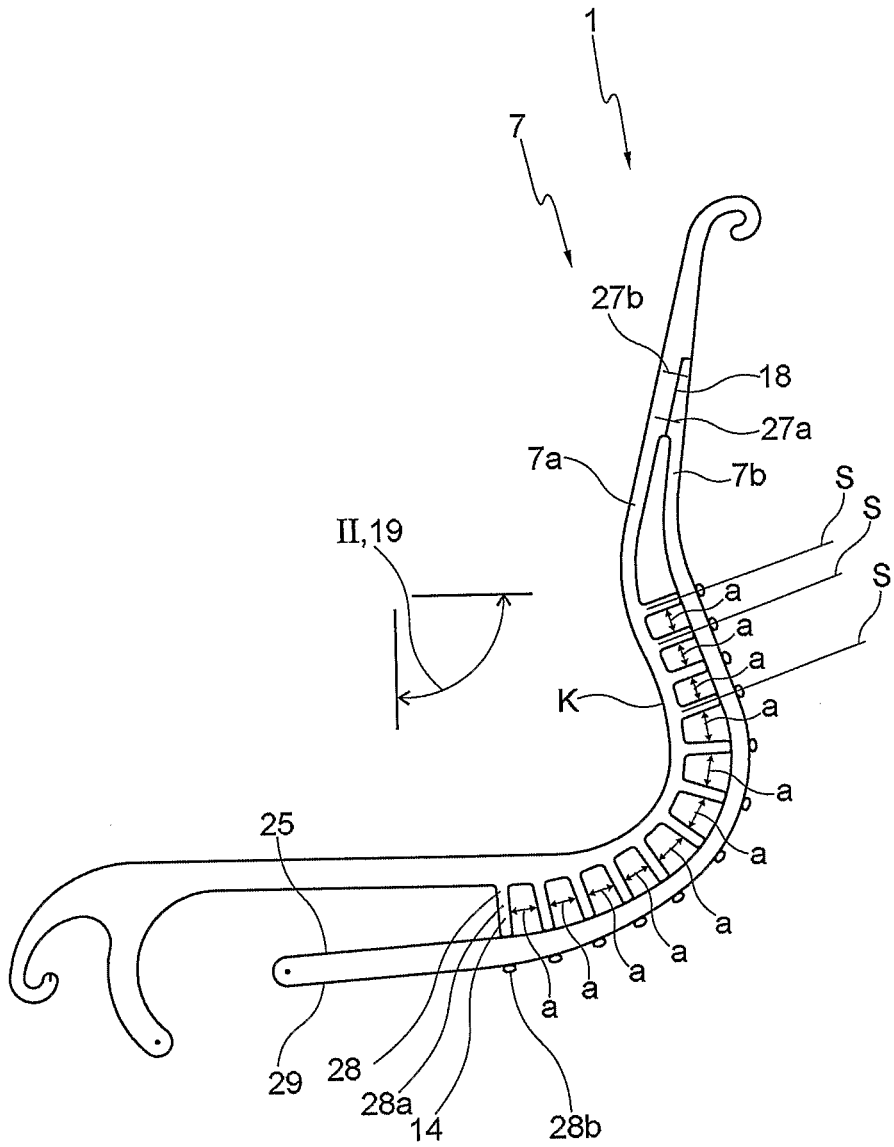
Figure 5B:
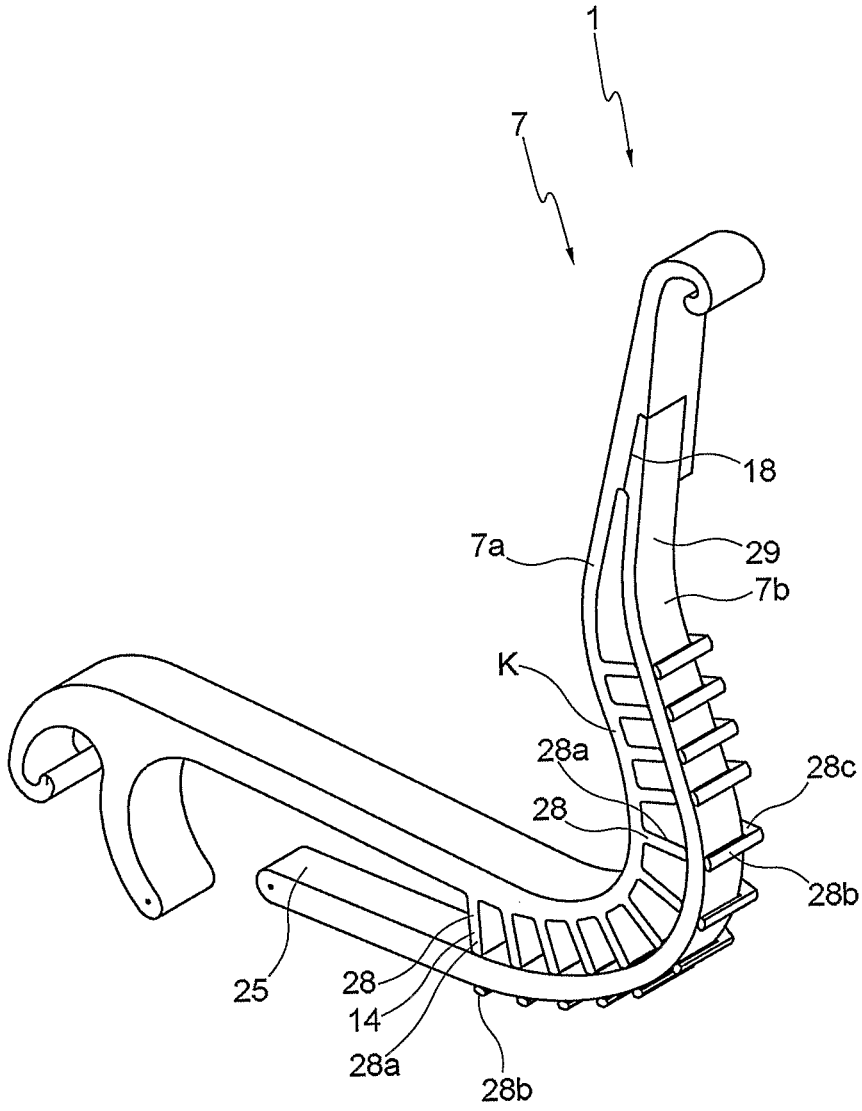

FIG. 5*a*: shows a side view of a fourth variant of a carrying arm;

FIG. 5*b*: shows a perspective view of the carrying arm which is shown in FIG. 5*a;*

Figure 6A:
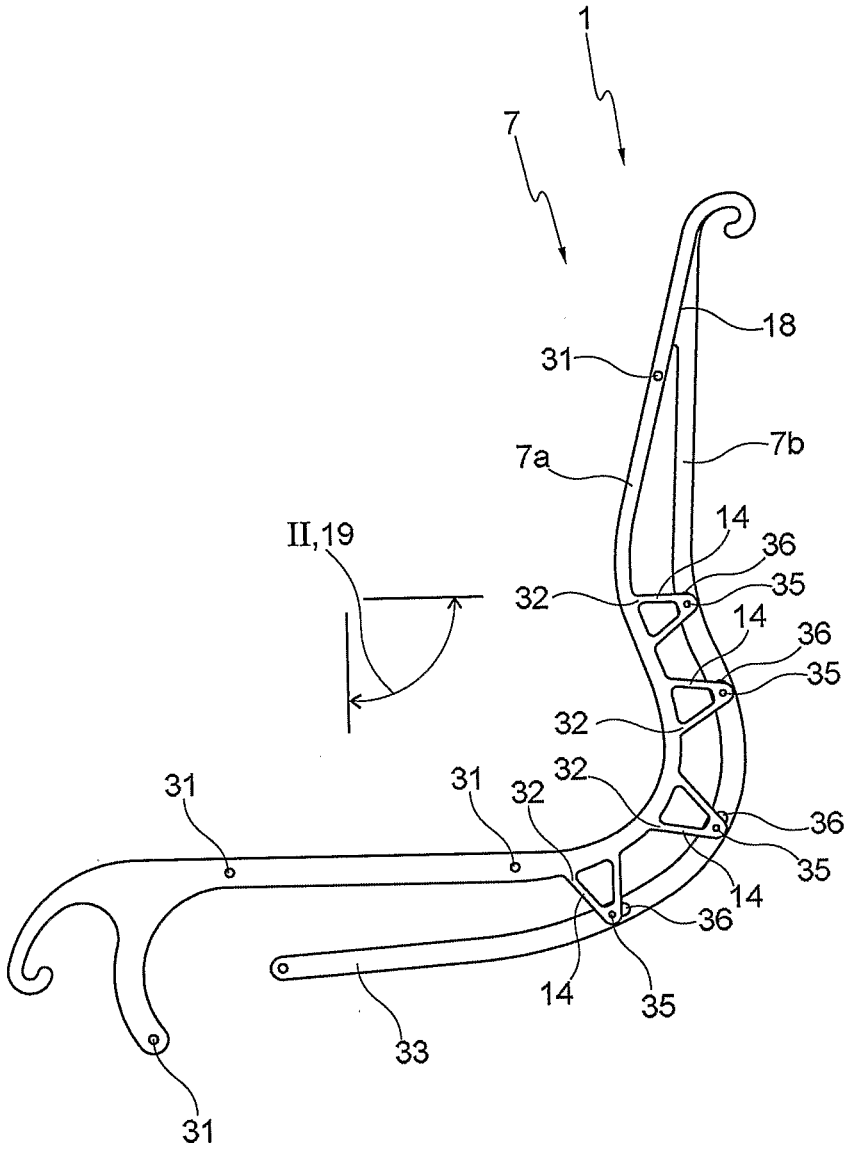
Figure 6B:
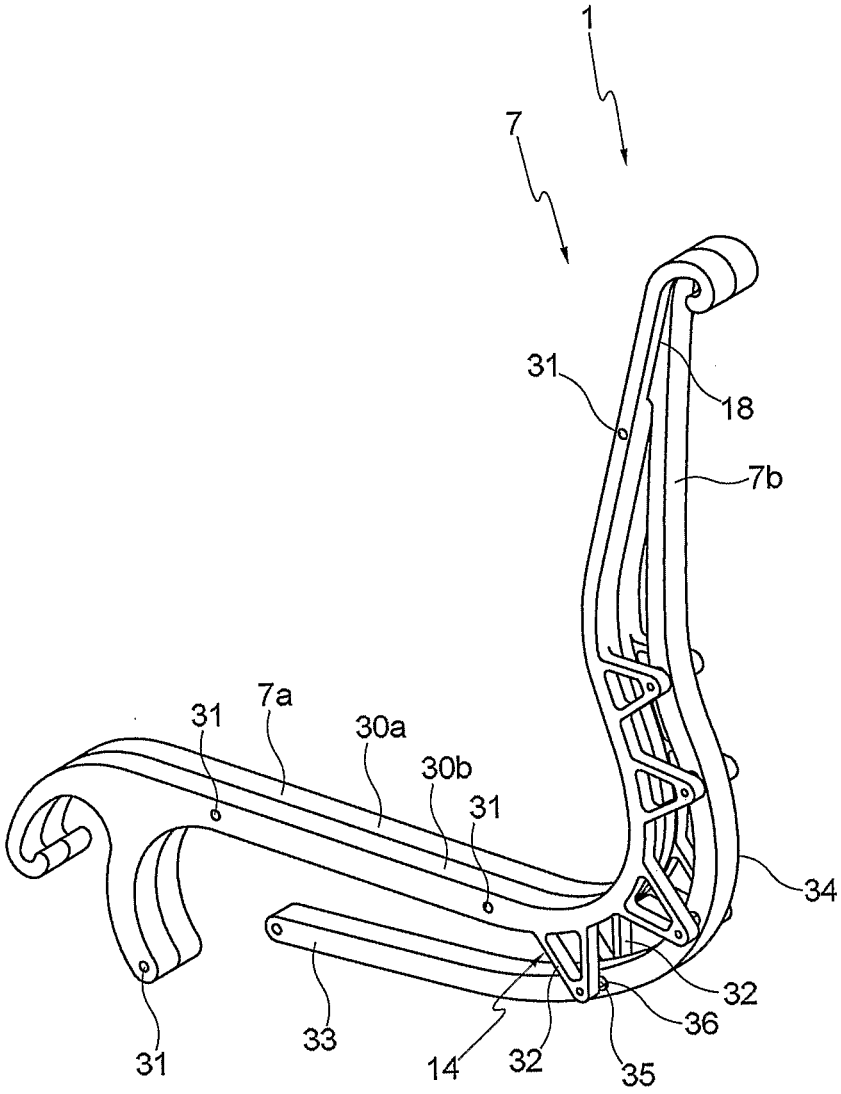

FIG. 6*a*: shows a side view of a fifth variant of the carrying arm;

FIG. 6*b*: shows a perspective view of the carrying arm which is shown in FIG. 6*a;*

Figure 7:
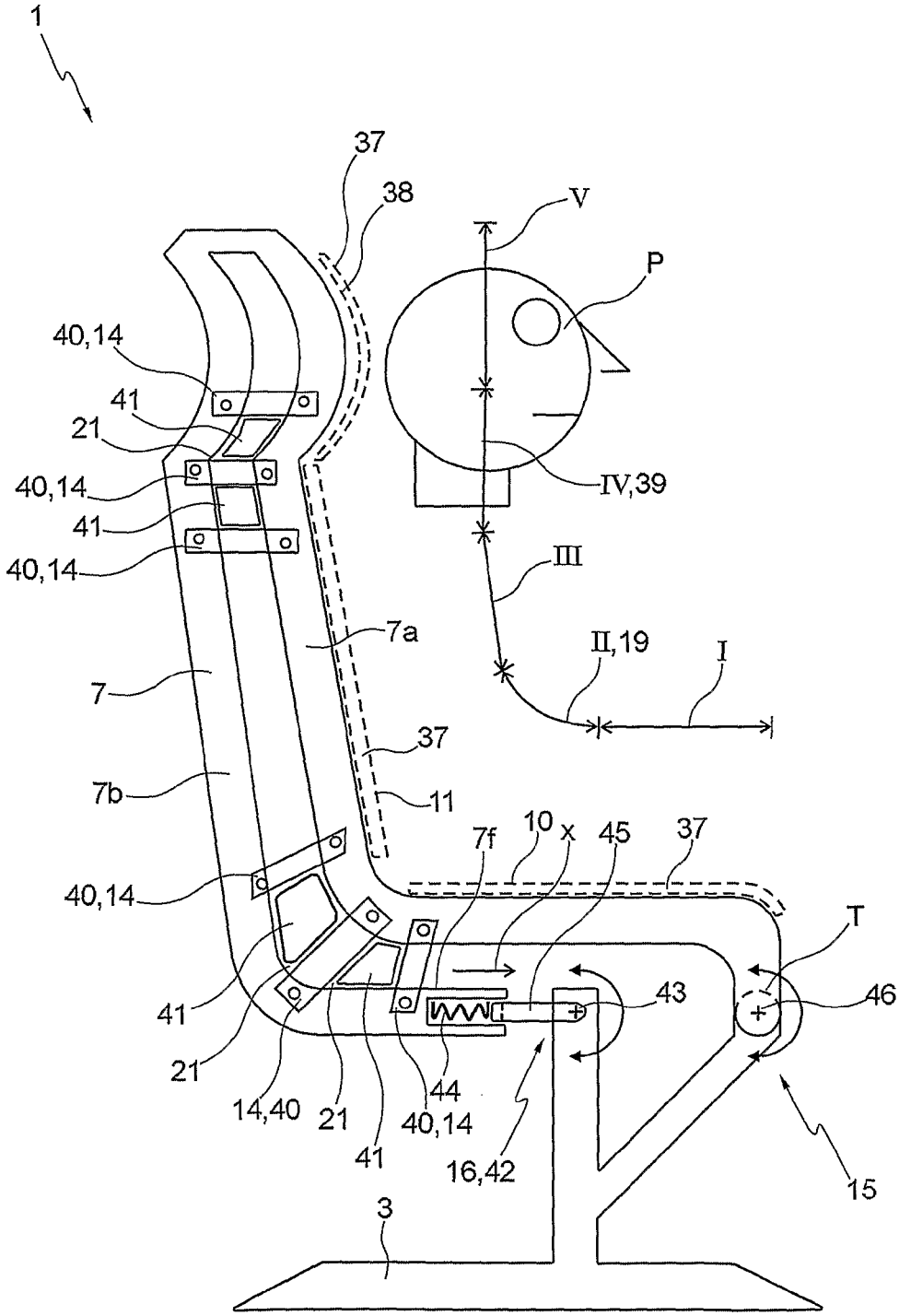
Figure 8:
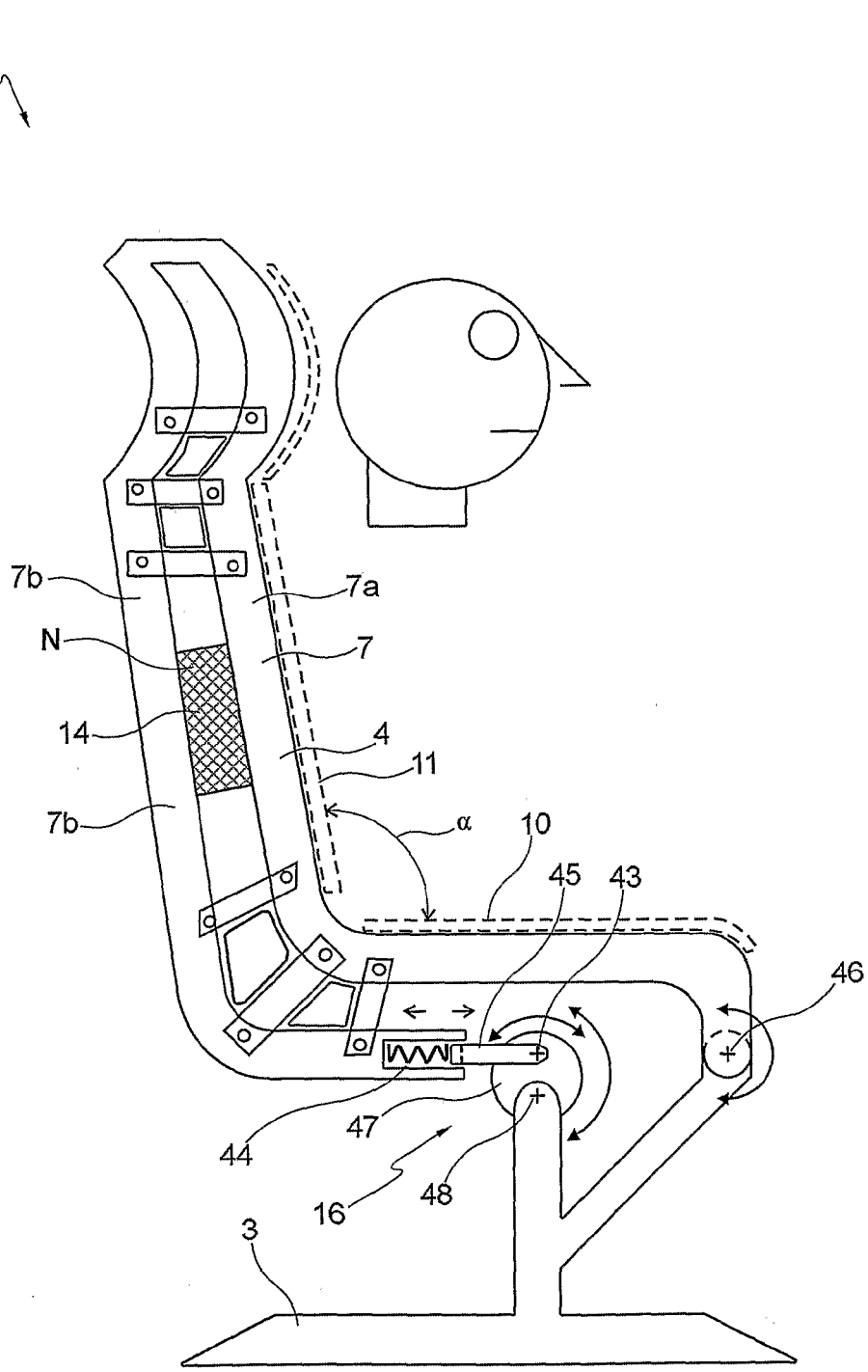
Figure 9:
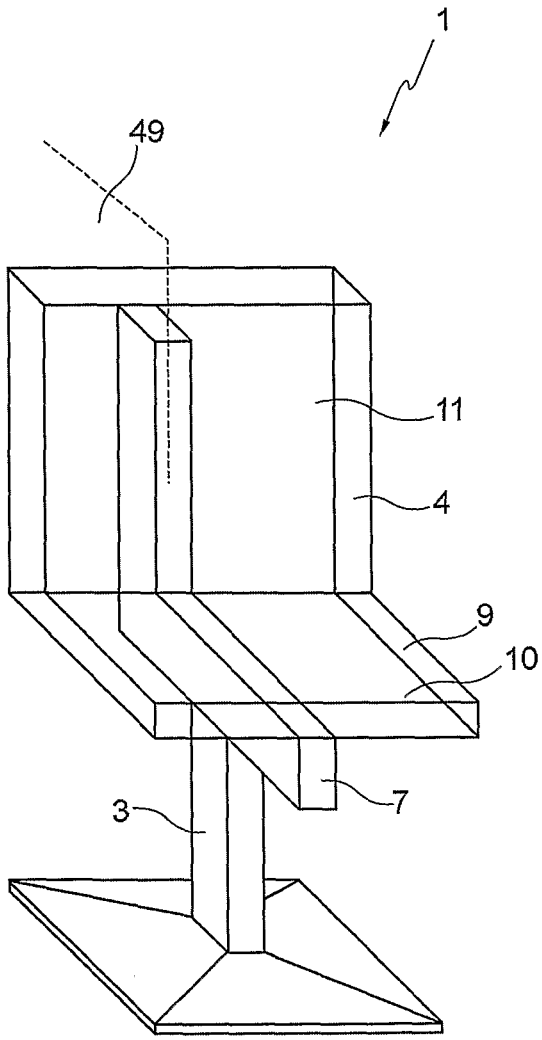
Figure 10:
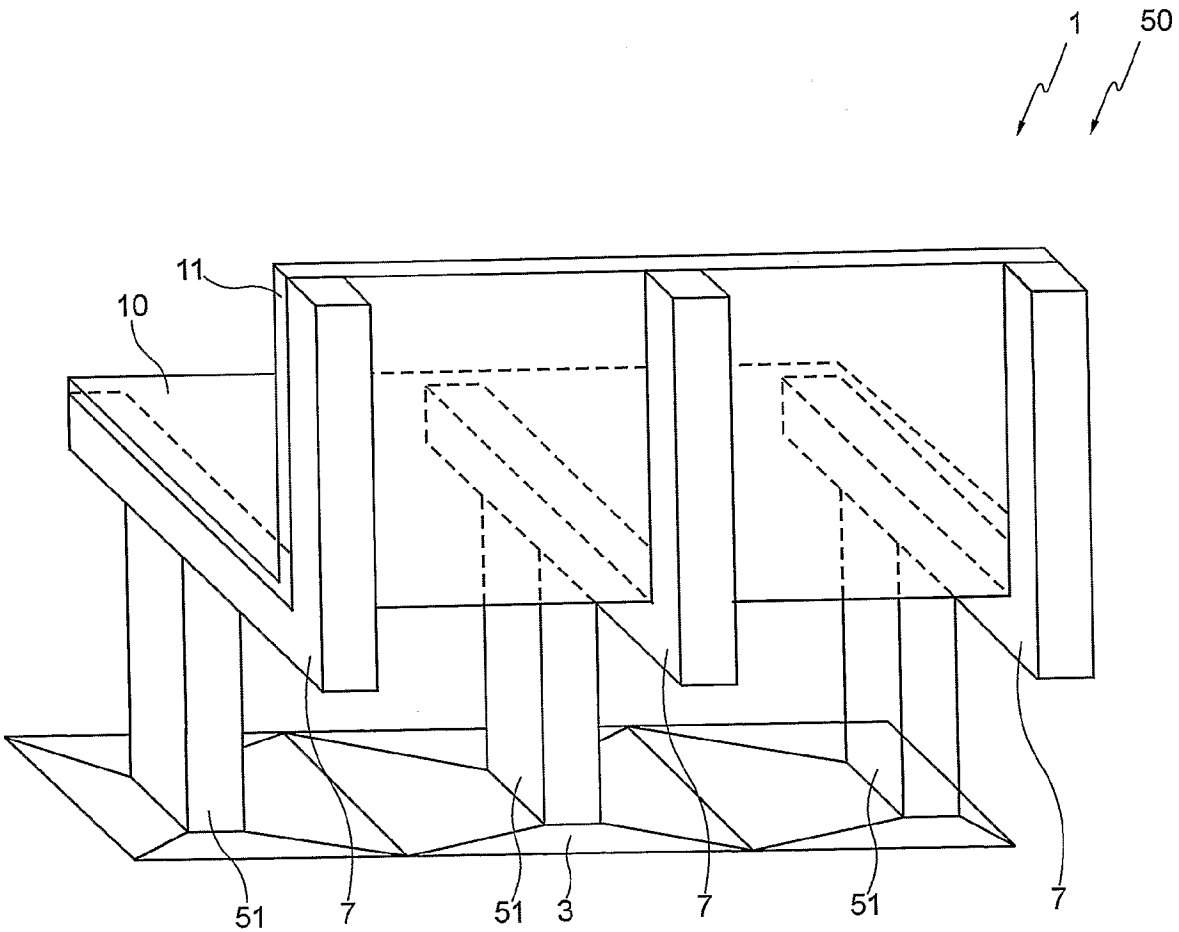
Figure 11:
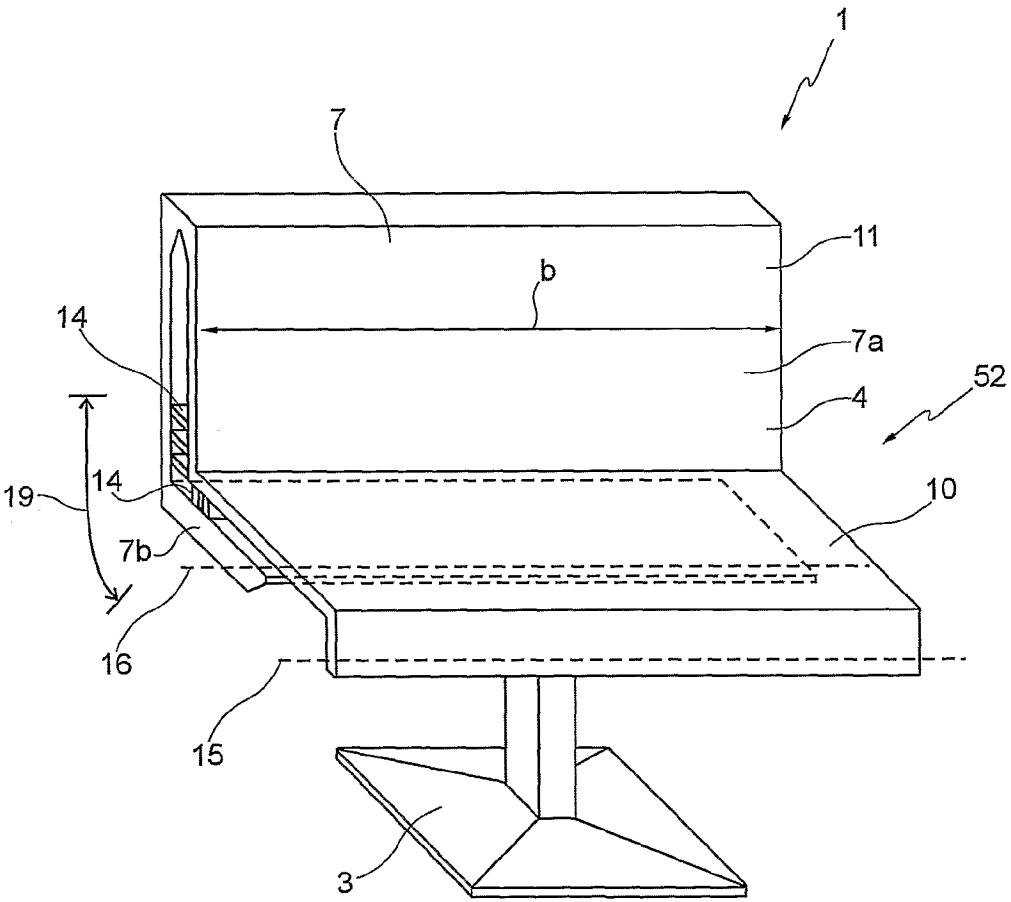
Figure 12A:
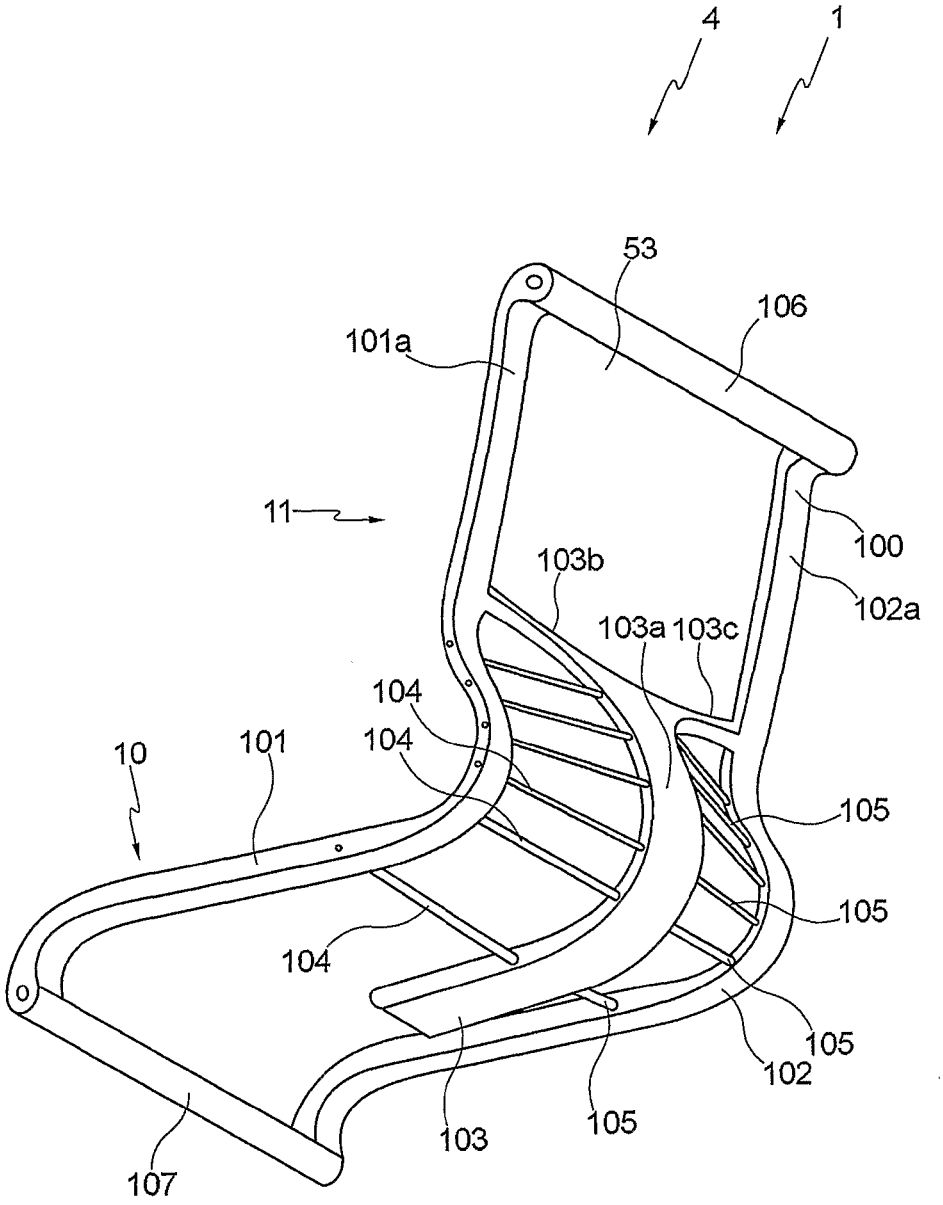
Figure 12B:
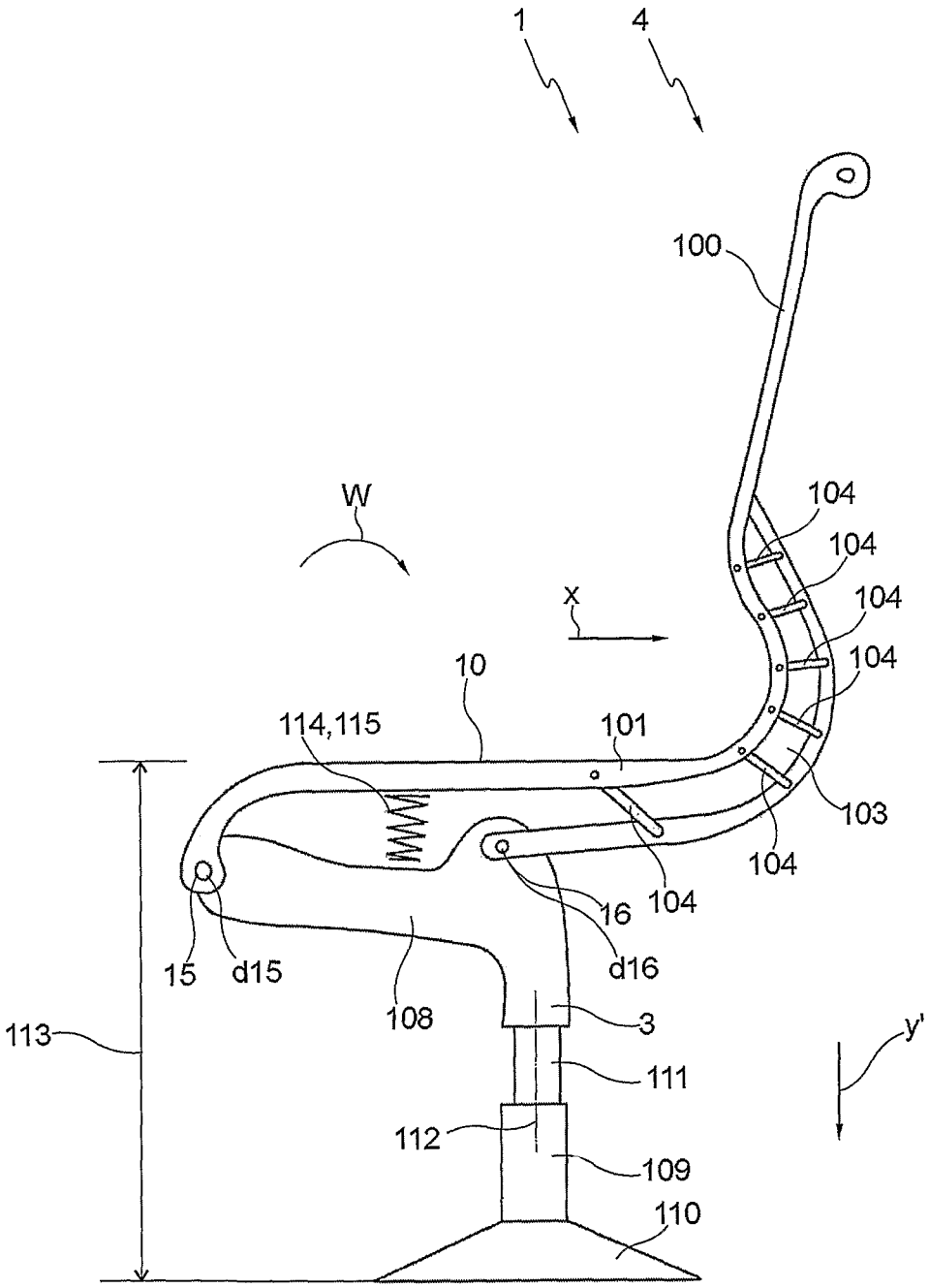

FIG. 7: shows a side view of a second variant of a seating arrangement;

FIG. 8: shows a side view of a third variant of a seating arrangement;

FIG. 9: shows a side view of the fourth variant of a seating arrangement;

FIG. 10: shows a side view of a fifth variant of a seating arrangement;

FIG. 11: shows a side view of a sixth variant of a seating arrangement;

FIG. 12*a*: shows a perspective view of a seat of a seventh variant of a seating arrangement;

FIG. 12*b*: shows a side view of the seating arrangement with the seat which is shown in FIG. 12*a;*

Figure 15:
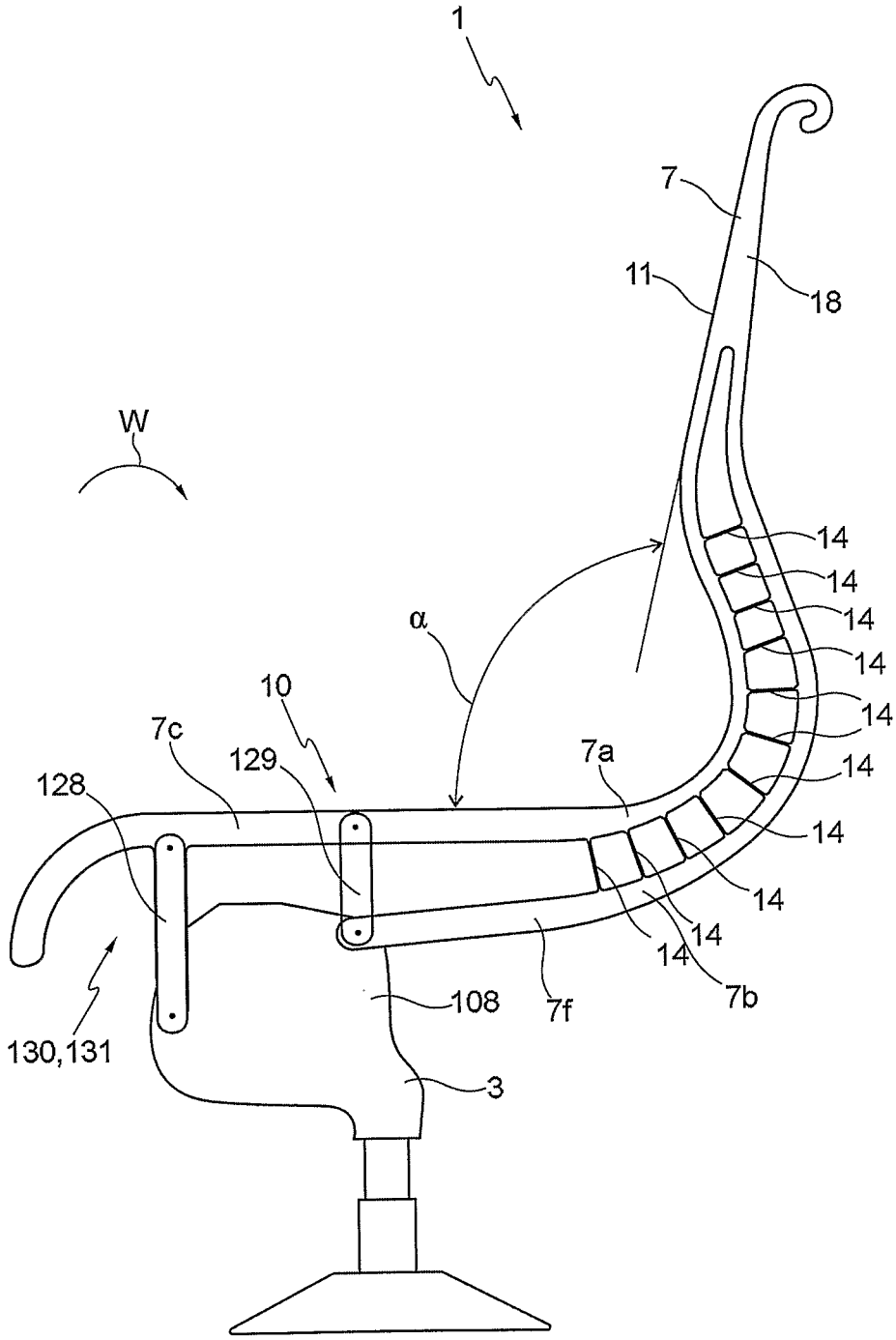
Figure 16:
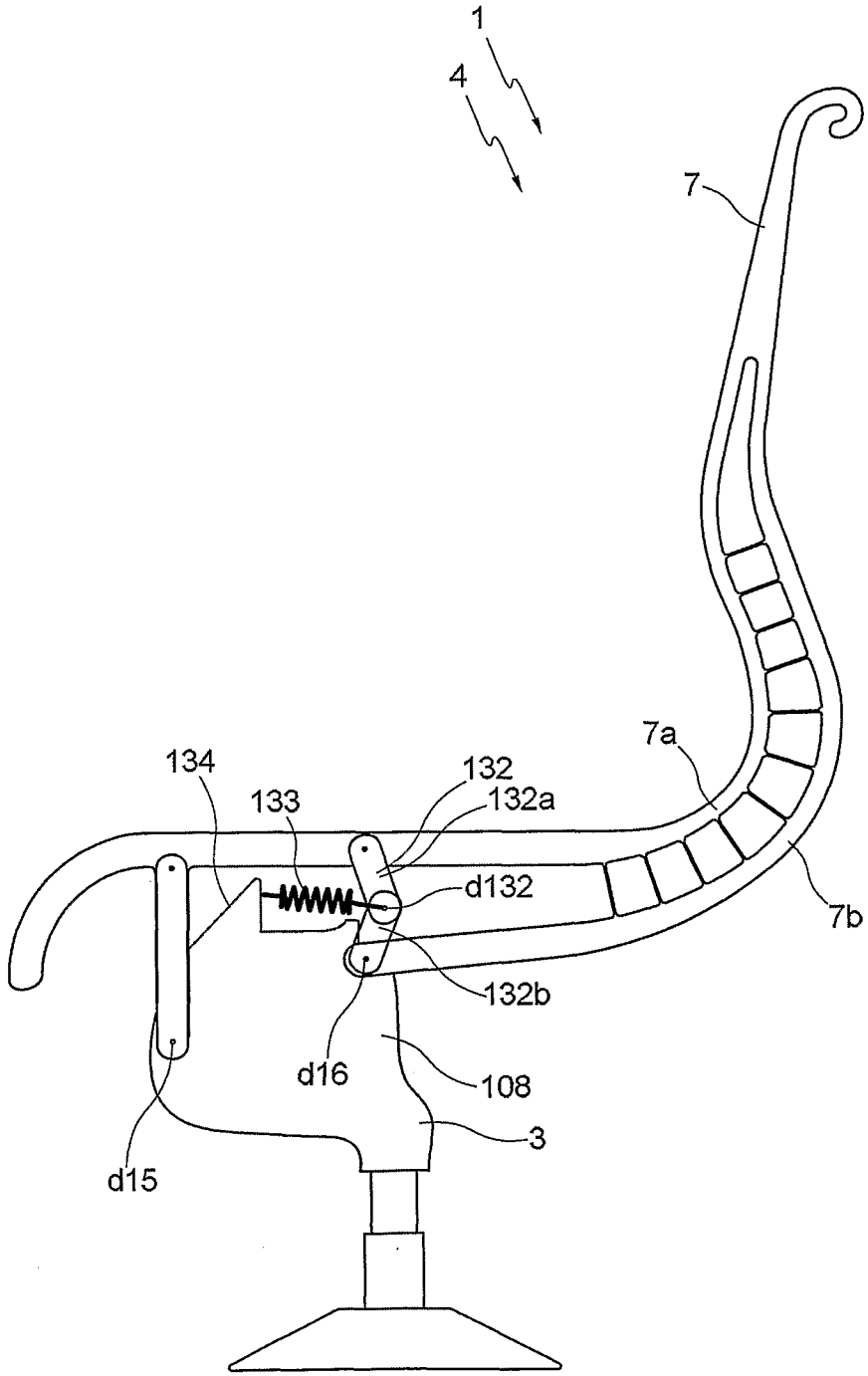
Figure 17:
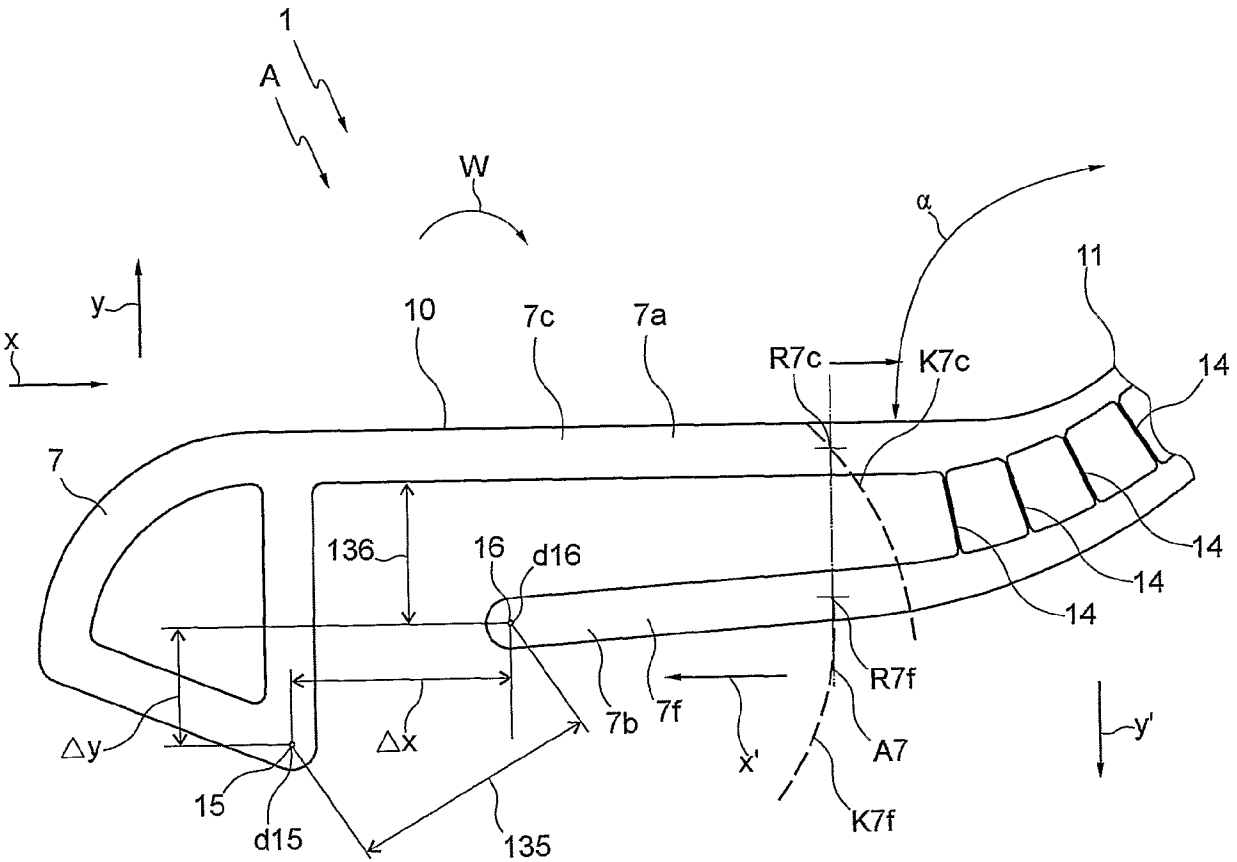

FIGS. 13-16: show side views of an eighth to eleventh variant of a seating arrangement; and FIG. 17 shows a detail-specific view of the carrying arm, with reference points, which is shown in FIGS. 2*a* and 2*b*.

FIG. 1*a* illustrates a perspective view of a first variant of a seating arrangement 1. The seating arrangement 1 is designed as an office chair 2, although it should be understood that it would be suitable for any body support structure, including for example and without limitation, other seating structures such as benches, car seats, aircraft seats, etc. The seating arrangement 1 is essentially made up of a substructure 3 and a seat 4. The substructure 3 comprises castors 5 and a pneumatic damper 6, the seat 4 being fastened on the head plate 17 (see FIG. 1*b*) of the gas damper. The seat 4 essentially comprises two carrying arms 7, 8, which bear a body support structure, shown for example as a seat shell 9, which forms a seat surface 10 and a backrest 11. Two transverse carriers 12, 13 extend between the two carrying frames 7 and 8. The carrying arms 7, 8 are essentially made up in each case of a first, upper carrier 7*a*, 8*a*, a second, lower carrier 7*b*, 8*b* and mechanical linking members 14. The mechanical linking members 14 each have a cross member and a pair of laterally extending arm portions that are pivotally connected to respective carriers 7*a*, 7*b*, 8*a*, 8*b* The carrying arm 8 will not be discussed in any detail hereinbelow since it is constructed in a manner corresponding to the carrying arm 7. The upper, first carrier 7*a* of the carrying arm 7 is made up of a substantially horizontal, first leg 7*c* and an upwardly directed, second leg 7*d*. By means of a front, free end 7*e*, the horizontal, first leg 7*d* of the first carrier 7*a* is mounted on a first bearing 15 such that it can be rotated about an axis of rotation d15. The first bearing 15 can be formed integrally as part of the carrier 7*a*, or can be formed as a separate bearing component mounted in the carrier. The first bearing 15 is a first location for the connection of the first carrier 7*a* of the seat 4 to the substructure 3. The lower, second carrier 7*b* of the carrying arm 7 is made up of a horizontal, first leg 7*f* and an upwardly directed, second leg 7*g*. By means of a front, free end 7*h*, the lower, second carrier 7*b* is mounted in a second bearing 16, which again can be formed integrally in the carrier 7*b* or as a separate component, such that it can be rotated about an axis of rotation d16. The second bearing 16 is a second location for the connection of the second carrier 7*b* of the seat 4 to the substructure 3. The bearings 15 and 16 are supported on the substructure 3 and/or the head plate 17 of the pneumatic damper 6 via struts 15*a*, 16*a* (see also FIG. 1*b*). FIG. 1*a* shows the seating arrangement 1 in a non-loaded, first position A. The seating arrangement 1 is constructed in a mirror-symmetrical manner, in particular as far as the carrying arms 7 and 8 are concerned, in relation to a plane 49, which stands vertically in space and divides the pneumatic damper 6.

FIG. 1*b* shows a further perspective view of the seating arrangement 1 which is known from FIG. 1*a*, the seating arrangement 1, once again, being in the first position A. The head plate 17 of the pneumatic damper 6, on which the struts 15*a* and 16*a* are retained, can be seen in FIG. 1*b*. The upwardly directed legs 7*d* and 7*g* of the two carriers 7*a* and 7*b* of the carrying arm 7 are connected to one another at a connecting location 18. With respect to the seat 4 the connecting location 18 of the two carriers 7*a* and 7*b* is a third location. Starting from this connecting location 18, the two carriers 7*a* and 7*b* run largely parallel until the lower, second carrier 7*b* merges into the second bearing 16. By virtue of the struts 15*a* and 16*a* and the transverse carriers 12 and 13, which are shown in FIG. 1*a*, the two carrying arms 7 and 8 are coupled to one another and support one another. The seat surface 10 and the backrest 11 of the seat 4 are formed by a cover 53, the cover 53 connecting the carrying arms 7 and 8 and being fastened essentially on the upper carriers 7*a* and 8*a*. The cover 53 can form the body support structure independently without a shell, or can be disposed over the shell.

FIG. 2*a* illustrates the side view of a second variant of a carrying arm 7. The carrying arm 7 has an upper, first carrier 7*a* and a lower, second carrier 7*b*. The upper, first carrier 7*a* is mounted on a bearing 15 (not illustrated specifically) by way of a front, free end 7*e*. Legs 7*c* and 7*d* of the upper, first carrier 7*a* run at an initial opening angle $\alpha=100°$ in relation to one another, the carrying arm 7 being illustrated in a first position A. In various suitable embodiments, the initial opening angle can range from about $\alpha=85°$ to about $\alpha=110°$. The legs 7*f* and 7*g* of the lower, second carrier 7*b* are arranged in an L-shaped manner corresponding to the legs 7*c* and 7*d*, the lower, second leg 7*b* being fastened in a rotatable manner on a bearing 16 (not illustrated specifically) by way of a free end 7*a*. The carrier 7 can be roughly subdivided into three sections I, II and III, the section I, corresponding to a front half of a seat surface 10 and a section III corresponding to an upper half of a backrest 11. The section II is located between sections I and III and is also referred to as the first transition region 19, in which the seat surface 10 merges into the backrest 11. Based on an individual seated on the seating arrangement 1, the first transition region 19 extends approximately from the lower dorsal vertebra to the thighs of the seated individual. In the transition region 19, eleven mechanical linking members 14 are arranged between the upper carrier 7*a* and the lower carrier 7*b*. These are configured as crosspieces 20*a* or film hinges 20*b*, the carriers 7*a*, 7*b* and the linking members 14 being integrally cast or injection molded in one piece, for example from plastic. Tunnels 21 are produced in each case between the carriers 7*a* and 7*b* and one or two linking members, these tunnels opening into and out of the plane of the drawing.

FIG. 2*b* shows a perspective view of the carrying arm 7 which is illustrated in FIG. 2*a*. The tunnels 21 here open in arrow directions z and z'. The linking members 14, in the transition region 19, run approximately radially in relation to the upper carrier 7*a* and the lower carrier 7*b*. The upper carrier 7*a*, in the transition region 19, has a radius r, which increases in the direction of legs 7*c* and 7*d*. Likewise, the lower carrier 7*b* in the transition region 19, has a radius R, which increases in the direction of legs 7*f* and 7*g*.

In one embodiment, the first carrier 7*a* has a cross sectional area of 1 $inch^2$ and a moment of inertia of 0.005000 $inch^4$ in the section II. In various exemplary and suitable embodiments, the cross sectional area can be from 0.3 $inch^2$ to 4 $inch^2$ and the moment of inertia can be from 0.000172 $inch^4$ to 0.011442 $inch^4$. Preferably, the cross-sectional area is at least 0.3 $inch^2$ and the moment of inertia is at least 0.000172 $inch^4$. In one embodiment, the linking members are spaced apart about 3 inch. In various exemplary embodiments, the linking members are spaced at least 0.5 inch, but preferably no more than 8 inch. In the section I the moment of inertia of the first carrier 7*a* increases in direction to the bearing 15 in comparison with the moment of inertia in the section II. In the section III the moment of inertia of the first carrier 7*a* is comparable with the moment of inertia of the carrier 7*a* in the section II. In all three sections I, II and III the second carrier 7*b* is dimensioned comparably to the corresponding section of the first carrier 7*a*. In various exemplary embodiments, the values for the moment of inertia and cross sectional areas differ from the values of the first carrier 7*a* by a factor from 0.5 to 1.5. Preferably the first and the second carrier 7*a*, 7*b* have a cross sectional area of the same shape. According to the embodiment of FIGS. 2*a* and 2*b* the cross sectional area has the shape of a rectangle. In various exemplary and suitable embodiments, the cross sectional area of the carriers 7*a*, 7*b* has the shape of a circle or an oval or a polygon.

The carriers can be made, for example and without limitation, of glass filled Nylon, unfilled Nylon, glass filled polypropylene, unfilled polypropylene, polycarbonate, polycarbonate/ABS blend, acetal, or combinations thereof. The linking members can be made of the same materials, or of various elastomeric materials, including without limitation, Hytrel, Nylon blended with elastomers, thermoplastic urethane or combinations thereof. The linking members can also be made of rigid materials, including various rigid plastics or metal.

Figure 3A:
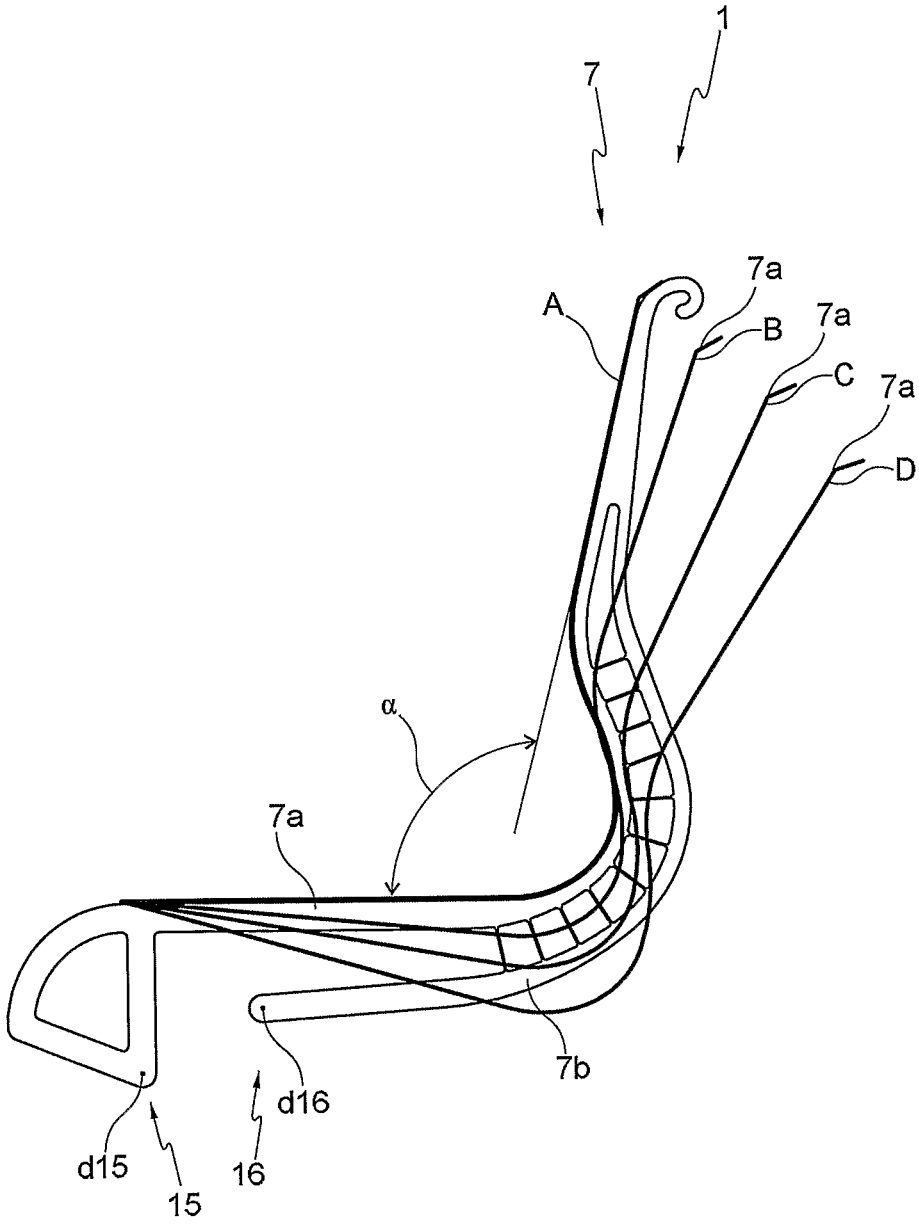
Figure 3B:
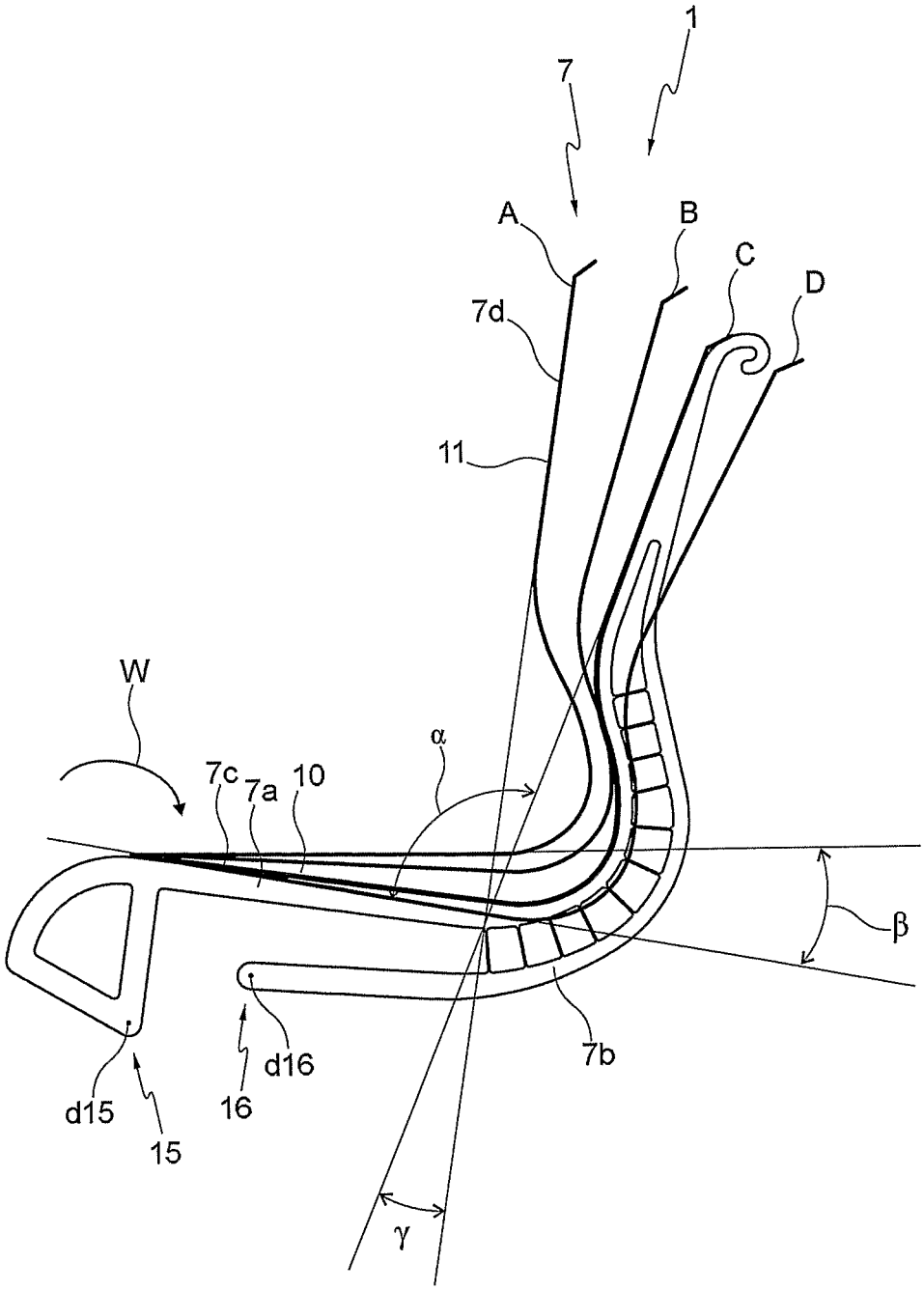
Figure 3C:
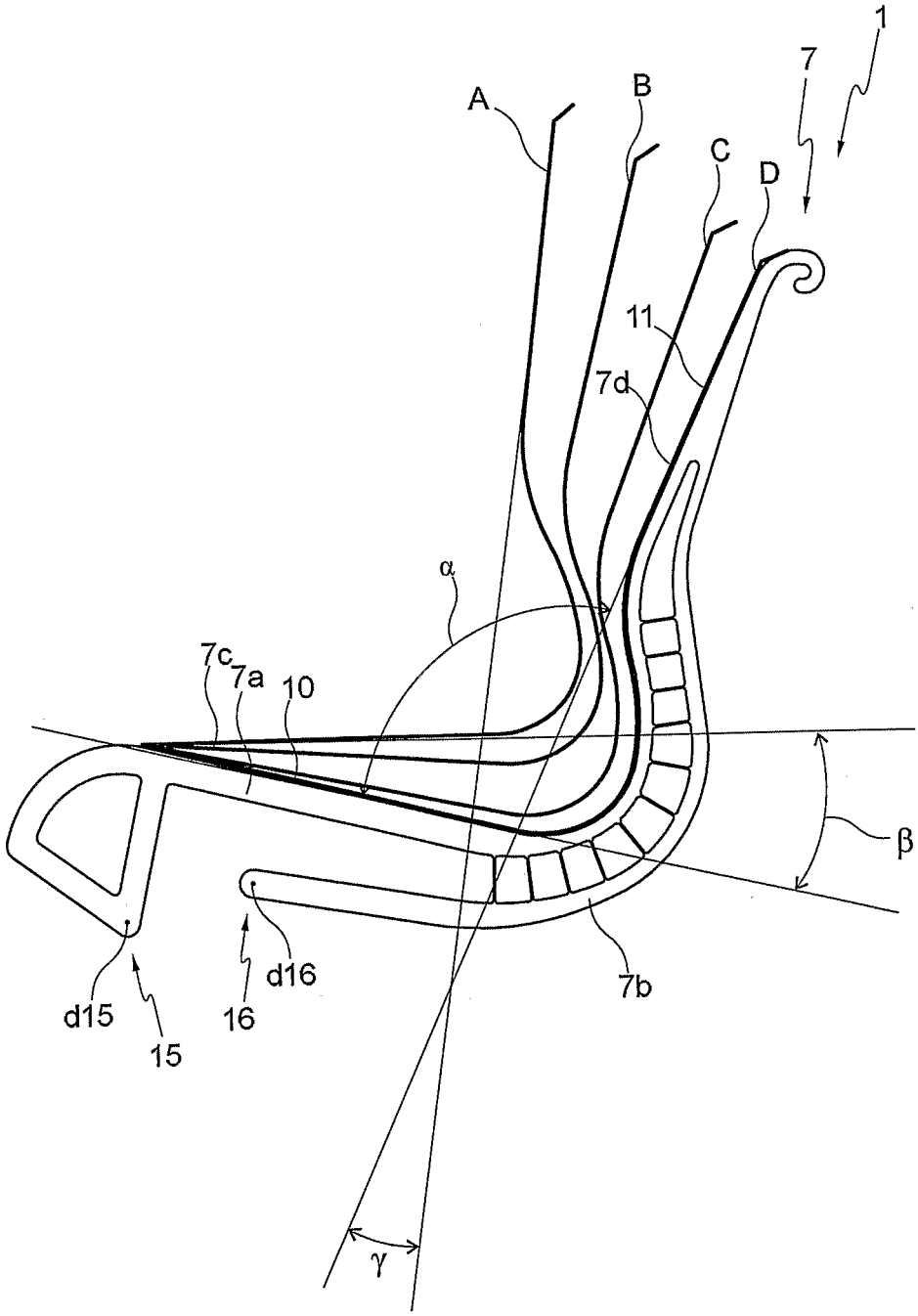

FIGS. 3*a* to 3*d* show schematic side views of a second variant of a carrying arm 7 of a seating arrangement 1 in different positions A, B, C, D and E. FIG. 3*a* shows the carrying arm 7 approximately in the first position A of the seating arrangement 1, this first position being known from the previous figures and corresponding to a basic position of the seating arrangement. Lines indicate the further positions B, C and D of an upper, first carrier 7*a* of the carrying arm 7, it being possible for the carrying arm 7 to assume these positions, for example, under the loading of an individual who is leaning back. These four positions A, B, C and D are indicated again in FIG. 3*b*, the carrying arm 7 being located in the intermediate position C. A springback action of the carrying arm 7, which is fastened on a substructure (not illustrated) in bearings 15 and 16 such that it can be rotated about axes of rotation d15 and d16, gives rise to a change in an opening angle α between legs 7*c* and 7*d* of the upper, first carrier 7*a* by 5° from α=100° (see FIG. 3*a*) to α=105° (see FIG. 3*b*). This change is also referred to as the opening or springback action of the carrying arm. In the case of this elastic springback action counter to the inherent stability of the carrying arm 7, a leg 7*c* of the carrying arm 7 moves downward, by rotation in an arrow direction w about the bearing 15, by an angle β=10° which defines an inclination of the seat surface 10 (see FIGS. 3*a* and 3*b*). The leg 7*c* of the upper carrying arm 7*a* either defines a seat surface 10 itself or forms the base for such a seat surface. Finally, in the case of a springback action of the carrying arm 7, it is also the case that the inclination of a backrest 11, which is defined by the leg 7*d* increases by an angle γ=15° between the positions A and C. FIG. 3*c*, finally, illustrates the carrying arm 7 of the seating arrangement 1 in the intermediate position D. In this position, the opening angle α between the legs 7*c* and 7*d* of the upper, first carrier 7*a* has increased to a α=110°. Furthermore, the seat inclination has adjusted to β=15° in relation to the position A, and the inclination of the upwardly directed leg 7*d* or the backrest 11 has increased by an angle γ=22° in relation to the position A. The carrying arm 7 is thus dimensioned such that, in the case of an elastic springback action of the carrying arm 7, the inclination of the backrest 11, or the inclination of the upwardly directed leg 7*d*, which is designated by the angle γ, increases to a more pronounced extent than the inclination of the seat surface 10 or the inclination of the horizontal leg 7*c*.

Figure 3D:
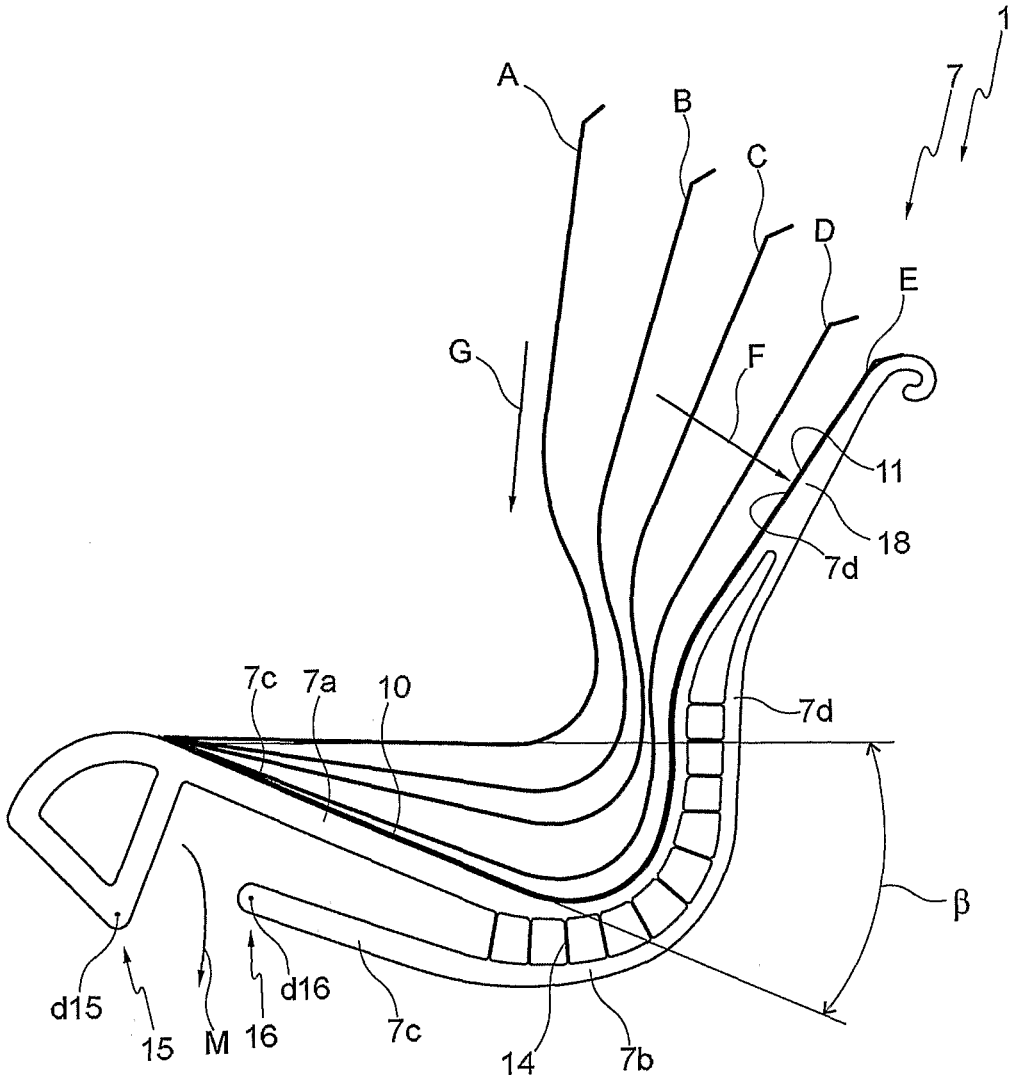

In FIG. 3*d*, the carrying arm 7 of the seating arrangement 1 is additionally shown in an end position E, which is not illustrated in FIGS. 3*a* to 3*c*, but which this carrying arm can assume under the envisaged loading. In this position E, the seat inclination, which is designated by the angle β, has changed, for example by β=20°, in relation to the position A. Basically, depending on the number and the positioning of the carrying arms 7 incorporated in the seating arrangement 1, an individual seated on the seating arrangement 1 has his or her weight G, or a corresponding fraction of this weight, acting on the carrying arm 7. In addition, the individual seated on the seating arrangement may also have a force F acting on the backrest 11 or the leg 7*d*, this force F being produced by the individual using, for example, his or her feet to support himself or herself on the ground. The two forces G and F give rise to a moment M about the bearing 15, on which the upper, first carrier 7*a* of the carrying arm 7 is articulated. This moment M is directed via the legs 7*c* and 7*d* of the upper, first carrier 7*a*, at a connecting location 18, into the second, lower carrier 7*b* of the carrying arm 7 and, optionally via the legs 7*d* and 7*c* of the latter or the legs 7*g* and 7*f*, is introduced into the substructure (not illustrated). The moment can be derived optionally via the upper or the lower carrier 7*a*, 7*b*. The carrying arm 7 functions reciprocally, the introduction of a moment about one of the two points of attachment thus causing the carrying arm to open and the opening of the carrying arm causing a moment about the points of attachment. Since this force flux takes place through an elastic component, namely the carrying arm 7, measures are taken here in order to impart varied properties to the carrying arm 7. These differing properties or requirements are constituted by the transmission of a large force and the springback action of the carrying arm 7 in the case of corresponding rearwardly directed force action. In order to realize these differing properties in one component, the carrying arm 7 has, between its upper carrier 7*a* and its lower carrier 7*b*, at least one mechanical linking member, which couples the two carriers 7*a* and 7*b* to one another in order to prevent the upper carrier 7*a* and/or the lower carrier 7*b* from bowing and/or buckling. It is thus possible to use two carriers 7*a* and 7*b* of small dimensions, in relation to the forces which are to be transmitted, to transmit large forces and, at the same time, to make a springback action possible.

In a manner analogous to FIGS. 2*a* and 2*b*, FIGS. 4*a* and 4*b* show a side view and a perspective view, this time of a third variant of a carrying arm 7 for a seating arrangement 1. An upper, first carrier 7*a* and a lower, second carrier 7*b* of the carrying arm 7 are connected in a section II (see FIG. 2*a*), which is also referred to as the first transition region 19, by twelve linking members 14, which are configured as plates 22. The plates 22 each have two mutually opposite cylindrical longitudinal sides 22*a* and 22*b* and are retained, by way of the latter, in undercut grooves 23*a* and 23*b*, respectively, which are arranged on mutually opposite inner sides 24 and 25 of the respective carriers 7*a* and 7*b*. The longitudinal sides 22*a* and 22*b* and the undercut grooves 23*a* and 23*b* extend in the z and z' directions (see FIG. 4*b*). Such a construction of the carrying arm 7 makes it possible to use different materials for the carriers 7*a* and 7*b* and the linking members 14. Furthermore, this multi-part construction of the carrying arms 7 also allows the plates 22 to be exchanged. The latter may be removed in the z and z' directions. As is indicated by way of example in FIG. 4*b*, the invention also makes provision for the plate 22 to be made up of at least 2 sub-plates 26*a*, 26*b* which have, for example, different properties and/or are produced from different materials.

FIGS. 5*a* and 5*b* show a side view and a perspective view of a fourth variant of a carrying arm 7 of the seating arrangement 1. The carrying arm 7 comprises an upper carrier 7*a* and a lower carrier 7*b* and, in comparison with the variants which are illustrated in FIGS. 2*a*, 2*b* and 4*a*, 4*b*, is configured in two parts, as far as the carriers 7*a* and 7*b* are concerned. The carriers 7*a* and 7*b* are adhesively bonded to one another at a connecting location 18. A screw connection, which is indicated in FIG. 5*a* and has screws 27*a* and 27*b*, is also provided as an alternative, or in combination with the adhesives. In a section II, which forms a first transition region 19, twelve mechanical linking members 14 are integrally formed on the upper carrier 7*a* of the carrying arm 7. These mechanical linking members 14 are arranged at approximately constant spacings a in the direction of radial lines S of a curve K, which is defined by the upper carrier 7*a*. The individual linking members 14 are configured as clamps 28, which engage beneath the lower carrier 7*b* by way of a jaw 28*a* on an inner side 25 and engage over the lower carrier 7*b* by way of a jaw 28*b* on an outer side 29. The jaws 28*a* and 28*b* of the clamps 28 are connected to one another by a crosspiece 28*c*. The clamps 28*b* guide the lower carrier 7*b* on the upper carrier 7*a*, it being possible for the lower carrier 7*b* to execute a slight sliding movement transversely to the course taken by the lines S.

FIGS. 6*a* and 6*b* show a side view and a perspective view of a fifth variant of a carrying arm 7 of a seating arrangement 1. As is known from the previous figures, the carrying arm is essentially made up of a first, upper carrier 7*a*, a second, lower carrier 7*b* and at least one mechanical linking member 14. The upper carrier 7*a* of the carrying arm 7, which is illustrated in FIGS. 6*a* and 6*b*, comprises two carrier halves 30*a* and 30*b* (see FIG. 6*b*), which are connected to one another by pins 31. It should be understood that the carrier halves can be alternatively connected with adhesives, other mechanical fasteners or combinations thereof. The lower carrier 7*b* is retained in a form-fitting manner between the carrier halves 30*a* and 30*b* of the upper carrier 7*a* at a connecting location 18. In a section II, which is also referred to as the first transition region 19, the two carrier halves 30*a*, 30*b* of the upper carrier 7*a* each have four extensions 32, integrally formed with the upper carrier in one embodiment, which are positioned against a front side 33 and a rear side 34 of the lower carrier 7*b*. The mutually opposite extensions 32 are connected to one another in each case by bolts 35, the bolts 35 engaging through the lower carrier 7*b* in slots 36. A mechanical linking member 14 is thus formed in each case by two mutually opposite extensions 32 and a bolt 35 in conjunction with a slot 36 of the lower carrier 7*b*. By virtue of the four mechanical linking members 14, the lower carrier 7*b* is guided on the upper carrier 7*a* over a curve which is defined by the position of the bolts 35, the slots 36 allow slight displacement of the carriers 7*a* and 7*b* in relation to one another.

FIG. 7 shows a side view of a second variant of a seating arrangement 1. The side view shows a carrying arm 7 which is articulated on a substructure 3 at bearings 15 and 16. In a view which is illustrated in FIG. 7, the carrying arm 7 conceals a further, identical carrying arm; to this extent, the design of the seating arrangement 1 is comparable to the design of the seating arrangement which is shown in FIGS. 1*a* and 1*b*. Upper, first carriers 7*a* of the two carrying arms 7 are connected to or covered by a body support structure, including for example and without limitation padding means 37, which form a seat surface 10, a backrest 11 and a headrest 38. The carrying arm 7 is subdivided into five sections I-V, the upper, first carrier 7*a* being connected to a lower, second carrier 7*b* by mechanical linking members 14 in a first transition region 19 and in a second transition region 39. The mechanical linking members 14 are mounted in a rotatable manner on the two carriers 7*a*, 7*b* and are configured as link plates 40.

The first transition region 19 is arranged between lower dorsal vertebra and the thighs of an individual P seated on the seating arrangements. The second transition region 39 is located in the region of cervical vertebra of the individual P seated on the seating arrangement 1. Elastic bodies 41 in each case are arranged in tunnels 21 formed between the upper carrier 7*a*, the lower carrier 7*b* and in each case two link plates 40. The elastic bodies 41 counteract, between the mechanical linking members 14, undesired deformation of the upper carrier 7*a* and/or of the lower carrier 7*b*. The bearing 16, rather than being configured just as a rotary bearing 42 with an axis of rotation 43, also has a spring element 44, counter to which the lower carrier 7*b* can spring inward or translate, by way of a leg 7*f*, in an arrow direction x against a pin 45, which is fastened in a rotatable manner at the axis of rotation 43. The bearing 15 has an axis of rotation 46, about which the carrying arm 7 can be rotated to a limited extent. In order to influence the movement behavior, it is also possible to arrange a torsion spring T here, this torsion spring acting counter to the torque produced by the seated individual. In particular, an adjustable torsion spring makes it possible to realize precisely adjustment of the movement behavior of the seating arrangement.

FIG. 8 illustrates a schematic side view of a third variant of a seating arrangement 1. This third variant of a seating arrangement 1 has great similarities to the second variant, which is illustrated in FIG. 7. In contrast to the second variant, a bearing 16 is provided with an eccentric shaft 47, which is mounted on a substructure 3 of the seating arrangement 1 such that it can be rotated about an axis of rotation 48. A pin 45 is mounted on the eccentric shaft 47 with an axis of rotation 43 arranged eccentrically in relation to the axis of rotation 48. A carrying arm 7 or a lower carrier 7*b* of the carrying arm 7 is spring-mounted such that it can translate fore and aft, and fastened eccentrically, on the bearing 16 via the pin 45 and a spring element 44. Depending on the design of the bearing 16, it is possible to influence the tilting behavior of seat 4, which is manifested by rotation about an axis of rotation 46, and/or the springback behavior between a seat surface 10 and a backrest 11. In contrast to FIG. 7, the seating arrangement which is illustrated in FIG. 8 also has a further mechanical linking member 14. The latter is configured as a woven-fabric or foamed body N which is adhesively bonded to carriers 7*a* and 7*b* of the carrying arm 7 for the purpose of transmitting forces.

FIG. 9 shows a schematically illustrated prospective view of a fourth variant of a seating arrangement 1. The illustration also shows concealed edges in some cases in the form of solid lines. A seat 4 is arranged on the substructure 3, this seat being made up essentially of a schematically illustrated carrying arm 7 and a body support structure, including for example and without limitation a seat shell 9. The seat shell 9 has a seat surface 10 and a backrest 11. A characteristic feature of this seating arrangement 1 is that this seat shell 9 is borne by a single carrying arm 7. The seating arrangement 1 is designed in a mirror-symmetrical manner in relation to a plane 49, the carrying arm 7, configured as any of the disclosed variants, being intersected centrally by the plane 49.

FIG. 10 shows, schematically, a perspective view of a fifth variant of a seating arrangement 1. The seating arrangement 1 is configured as a bench 50 which has a substructure 3 with three columns 51. A carrying arm 7 according to the invention is arranged on each of the three columns 51. The carrying arms 7, configured as any of the disclosed variants, together bearing a seat surface 10 and a backrest 11.

Finally, FIG. 11 shows, schematically, a perspective view of a sixth variant of a seating arrangement 1. The seating arrangement 1 comprises a substructure 3 and a carrying arm 7 arranged thereon. The carrying arm 7, forms a seat 4. The carrying arm 7 has a width b which corresponds to the width of the seating arrangement 1 and thus forms, by virtue of an upper, first carrier 7*a* itself, a seat surface 10 and a backrest 11. The upper carrier 7*a* is connected to a lower carrier 7*b* in a first transition region 19 via mechanical linking members 14. The mechanical linking members 14 extend over the entire width b of the carrying arm 7. The seat 4, which is formed solely by the carrying arm 7, is articulated on the substructure 3 via bearings 15 and 16. The seating arrangement 1 forms a chair 52 with this substructure.

FIG. 12*a* illustrates a perspective view of a seat 4 of a seventh variant of a seating arrangement 1. The seat 4 has a carrying arm 100 which bears a body support structure, for example and without limitation a cover 53, which forms a seat surface 10 and a backrest 11. The carrying arm 100 comprises a left-hand upper carrier 101, a right-hand upper carrier 102 and a lower carrier 103, which is located between the upper carriers and is offset downward in an arrow direction y' in relation to the same. The lower carrier 103 is connected to the left-hand upper carrier 101 by mechanical linking members 104 and is connected to the right-hand upper carrier 102 by further mechanical linking members 105. The upper carriers 101 and 102 are connected to one another by two transverse carriers 106 and 107. An upwardly directed, approximately vertical leg 103*a* of the lower carrier 103 is divided into two struts 103*b*, 103*c* and merges, by way of these struts, into upwardly directed legs 101*a*, 102*a* of the upper carriers 101, 102. The upper carriers 101 and 102 and the lower carrier 103 thus form the single-piece carrying arm 100.

FIG. 12*b* shows a side view of the seating arrangement 1 of which the seat 4 is already known from FIG. 12*a*. The side view also illustrates a substructure 3 of the seating arrangement 1. The substructure 3 comprises an upper part 108, a central part 109 and a lower part 110. The upper part 108 is resiliently mounted on the central part 109 and lower part 110, together with the seat 3, by a height-adjustable spring element 111. The height-adjustable spring element 111 is configured as a pneumatic spring 111*a*. The pneumatic spring 111*a* makes it possible for the upper part 108 and the seat 4, which is mounted thereon, to rotate about a vertical axis of rotation 112. The pneumatic spring 111*a* also allows a seat height 113 to be adjusted. The upper carriers 102—in FIG. 12*b*, the carrier 102 is concealed by the carrier 101—are articulated on the upper part 108 such that they can be rotated via rotary bearings 15 with a common axis of rotation d15. The lower carrier 103 is articulated on the upper part 108 such that it can be rotated via a rotary bearing 16, about an axis of rotation d16. In addition to the resilient mounting on the upper carrier 101, which can be brought about by the carrying arm 100, the seat 4 is resiliently mounted on the upper part 108 by two spring elements 114. Only the spring element 114 which is located beneath the upper carrier 101 is visible in the side view. The two spring elements 114 are designed as helical springs 115. In respect of the deformation of the seat 4 and/or the carrying arm 100, reference is made, in particular, to the description relating to FIGS. 3*a* to 3*d*. The spring elements 114 make it possible to influence the behavior of the seat 4 by straight forward and cost-effective means. The lower carrier 103 is offset to the right in an arrow direction x, and downward in an arrow direction y', in relation to the upper carriers 101.

FIGS. 13 to 16 illustrate side views of further variants of a seating arrangement 1, the seating arrangement 1 having a seat 4 which in respect of two carrying arms 7 and the arrangement of the two carrying arms 7, is of comparable construction to the seat which is shown in FIGS. 1*a* and 1*b*. The second carrying arm is completely concealed by the first carrying arm 7 in the side views of FIGS. 13 to 16. In order to simplify the description, only the first carrying arm 7 and the fastening thereof on a substructure 3 will be described. The second carrying arm, which is not visible, is of identical construction.

Figure 13:
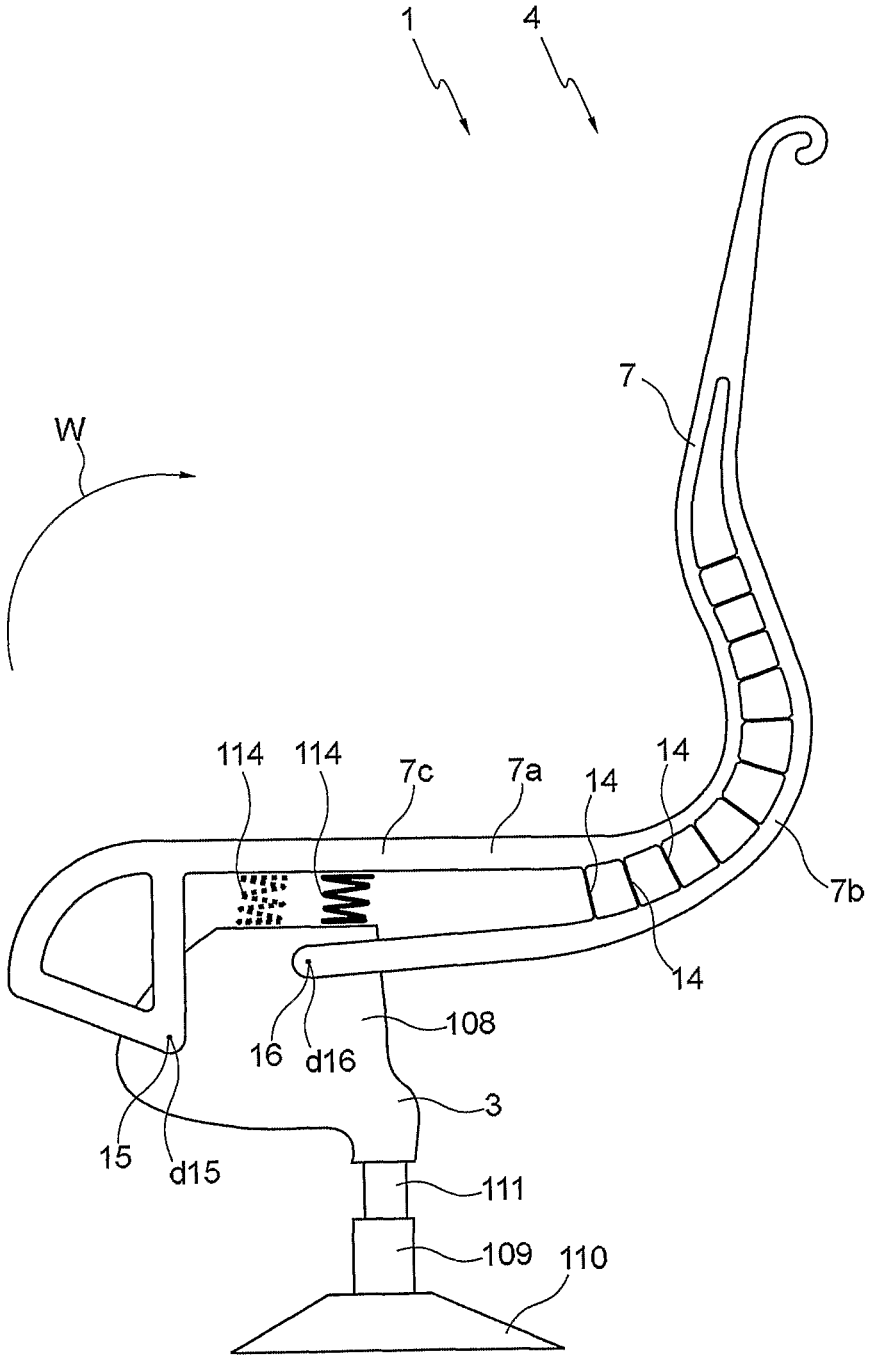

In the case of eighth variant of the seating arrangement 1, which is illustrated in FIG. 13, an upper carrier 7*a* is articulated on an upper part 108 of the substructure 3 such that it can be rotated in a first bearing 15, about an axis of rotation d15. Furthermore, a lower carrier 7*b* of the carrying arm 7 is articulated on the upper part 108 such that it can be rotated in a second bearing 16, about an axis of rotation d16. The upper carrier 7*a* and the lower carrier 7*b* are connected to one another via mechanical linking members 14, the lower carrier 7*b* being offset in relation to the upper carrier 7*a*. The substructure 3 includes the upper part 108, a central part 109, a lower part 110 and a height-adjustable spring element 111 mounted between the upper part 108 and the central part 109. In a manner corresponding to FIG. 1*a*, the lower part 110 may also be configured as a base part with castors. The upper carrier 7*a* of the carrying arm 7 is resiliently mounted on the upper part 108 of the substructure 3 via a spring element 114. For this purpose, the upper carrier 7*a* rests on the spring element 114 by way of its horizontal, first leg 7*c*. In respect of the elastic deformation of the seat 4 and/or the carrying arm 7, reference is made, in particular, to the description relating to FIGS. 3*a* to 3*d*. The additional support against a rotary movement of the carrying arm 7 about the axes of rotation d15 and d16 in a direction of rotation w can be modified by the properties of the spring element 114 and also by the positioning thereof. Dashed lines have been used to illustrate an alternative positioning of the spring element 114.

Figure 14:
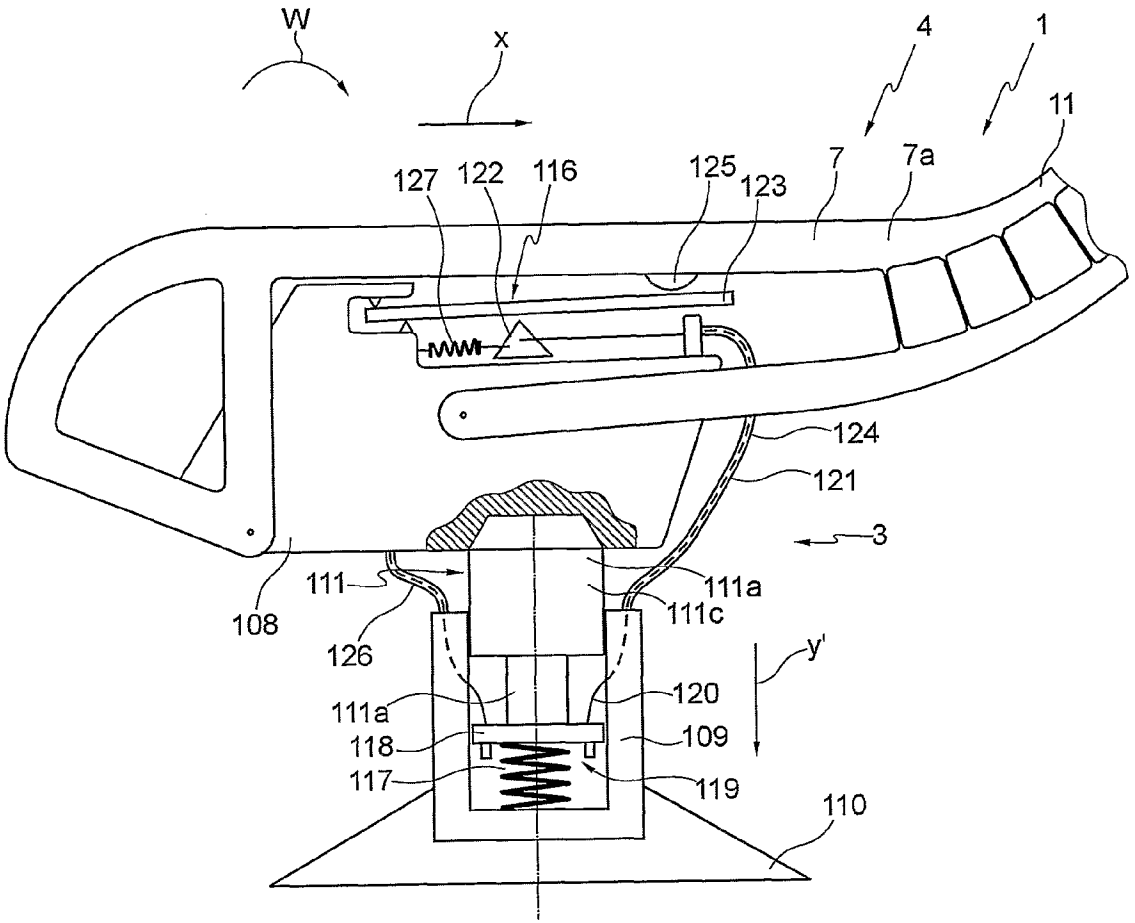

FIG. 14 shows the abovementioned ninth variant of the seating arrangement 1 with a spring mechanism 116. The second carrying arm, which is not visible in the side view, is assigned a spring mechanism of identical construction, which is completely concealed by the first spring mechanism 116. The substructure 3 of the seating arrangement 1 comprises an upper part 108, a central part 109 and a lower part 110. A height-adjustable spring element 111 is arranged between the upper part 108 and the central part 109. The upper part 108 also bears the spring mechanism 116. The height-adjustable spring element 111 comprises a pneumatic spring 111*a* and a spring element 117 arranged beneath a piston rod 111*b* of the pneumatic spring 111*a*. The piston rod 111*b* is guided in a pressure tube 111*c*. The upper part 108 is fastened on the pressure tube 111*c*, the pressure tube 111*c* being guided with sliding action in the vertical direction in the central part 109. The pneumatic spring 111*a* is supported on the spring element 117 by a flange plate 118 arranged on the piston rod 111*b*. The flange plate 118 and the spring element 117 form a weighing mechanism 119, which can establish the weight to which the seat 4 is subjected by an individual. The spring mechanism 116 is controlled via the weighing mechanism 119. A wire 120 of a Bowden cable 121 is fastened on the flange plate 118 of the weighing mechanism 119 and transmits the movement of the flange plate 118 to a bearing means 122, which is guided in a displaceable manner beneath a leaf spring 123. The spring mechanism 116 mentioned above comprises essentially the bearing means 122 and the leaf spring 123. The wire 120 of the Bowden cable 121 is guided in a hose 124, the hose being supported on the central part 108 and on the upper part 109. A vertical movement of the flange plate 118 in a direction y' causes the bearing means 122 to be drawn horizontally to the right in an arrow direction x by the Bowden cable 121. An upper carrier 7*a* of the carrying arm 7 thus undergoes relatively pronounced resilient deflection, corresponding to the loading to which the seat 4 is subjected, when the leaf spring 123 positions itself on the bearing means 122 as an individual sitting on the seat leans back. The upper carrier 7*a* is supported on the leaf spring 123 by way of a protrusion 125. A second Bowden cable 126 is fastened on the flange plate 118. This second Bowden cable controls the second spring mechanism (not visible), which is assigned to the second carrying arm (not visible). When the seat 3 is relieved of loading, the bearing means 122 is drawn back by a spring element 127 into the position which is shown in FIG. 14. A level of prestressing of the leaf spring 123 is such that the bearing means 122 can move without any contact with the leaf spring 123 as long as an individual is only sitting on the seat in the upright position. The leaf spring 123 positions itself on the bearing means 122 for the first time when the individual leans back from their upright position, in a direction of rotation w, against a backrest 11, only the start of which is illustrated in FIG. 11. The spring mechanism 114 supports the leaning-back movement of an individual in a weight-dependent manner. The seating arrangement 1 thus provides individuals of different weights with a high level of comfort without resilient deflection of the backrest having to be adjusted.

FIG. 15 illustrates the tenth variant of the seating arrangement 1. An upper carrier 7*a* of the carrying arm 7 is articulated on an upper part 108 of the substructure 3 via two levers 128 and 129. The levers 128 and 129, along with the upper carrier 7*a*, form a so-called four-bar linkage 130. This four-bar linkage 130 forms a coupling mechanism 131, which defines a tilting movement executed by the upper carrier 7*a* and/or a seat surface 10 when the seating arrangement 1 is subjected to loading by an individual sitting on it. Of course, a lower carrier 7*b*, which is connected to the upper carrier 7*a* at a connecting location 18 and by a number of linking members 14, counteracts a lowering movement of the upper carrier 7*a* in the manner described. Furthermore, a lowering movement of legs 7*c* and 7*f* of the carriers 7*a* and 7*b* in a direction of rotation w also results in an increase in an opening angle α between the seat surface 10 and a backrest 11.

FIG. 16 illustrates a side view of the eleventh variant of a seating arrangement 1. An upper carrier 7*a* of the carrying arm 7 is articulated on an upper part 108 of the substructure 3 such that it can be rotated about an axis of rotation d15. Furthermore, a lower carrier 7*b* of the carrying arm 7 is articulated on the upper part 108 such that it can be rotated about an axis of rotation d16. In addition, the upper carrier 7*a* of the carrying arm 7 is articulated on the upper part 108 via a toggle 132, for rotation about the axis of rotation d16. The toggle 132 comprises an upper lever 132*a*, which is fastened in a rotatable manner on the upper carrier 7*a*, and a lower lever 132*b*, which can be rotated about the axis of rotation d16. The two levers 132*a* and 132*b* are connected to one another in an articulated manner about an axis of rotation d132. A spring 133 draws the toggle 132, by way of its lower lever 132*a*, against a stop 134, which is formed on the upper part 108. This spring mechanism 116, which is formed essentially from the toggle 132 and the spring 133, retains the seat 4 with an additional force in the position which is shown in FIG. 16.

FIG. 17 shows a detail-specific view of the carrying arm 7 which is shown in FIGS. 2*a* and 2*b*. An upper reference point R7*c* is arranged on the horizontal, first leg 7*c* of the upper carrier 7*a*, and a lower reference point R7*f* is arranged on the horizontal, first leg 7*f* of the lower carrier 7*b*. The two reference points R7*c*, R7*f* are located on a vertical axis A7 in the non-loaded position A of the seating arrangement 1, which is shown in FIG. 17. When the seat 5 is subjected to loading and the carriers 7*a* and 7*b* are rotated correspondingly about their bearings 15 and 16 or axes of rotation d15 and d16, the two reference points R7*c*, R7*f* move vertically downward in an arrow direction y' and move apart from one another in the horizontal direction. During the lowering movement, the imaginary reference point R7*c* moves over a circular path K7*c* about the axis of rotation d15 and the imaginary reference point R7*f* moves over a circular path K7*f* about the axis of rotation d16. When the carrying arm 7 is subjected to loading by an individual (not illustrated), the carriers 7*a* and 7*b* rotate in a direction of rotation w about their axes of rotation d15 and d16. The offset arrangement of the axes of rotation d15 and d16 means that this results in the horizontal legs 7*c* and 7*f* of the two carriers 7*a* and 7*b* being displaced in opposite directions. The upper carrier 7*a* is displaced in the direction of the backrest 11, which is only indicated in FIG. 17, and the lower carrier 7*b* is displaced in the direction of its bearing 16. This displacement of the carriers 7*a* and 7*b* in opposite directions, brought about by the seating arrangement 1 being subjected to loading, results in the carrying arm 7 being extended where the carriers 7*a* and 7*b* are connected to one another by the linking members 14. When the approximately horizontal legs 7*c* and 7*f* of the carriers 7*a* and 7*b* are lowered, there is thus also an increase in the opening angle α between the seat surface 10 and the backrest 11, as is shown in FIGS. 3*a* to 3*d*. In order to allow this elastic deformation of the carrying arm 7, the carriers 7*a* and 7*b* are of resilient and elastic configuration in the region of their linking members 14. In order for the displacement of the carriers 7*a* and 7*b* in opposite directions to be achieved in the desired manner, the axis of rotation d16 is located above the axis of rotation d15, as seen in the vertical direction y, and the axes of rotation d15 and d16 are spaced apart from one another in the horizontal direction x. For the variant which is shown in FIG. 17, a spacing 135 provided between the axes of rotation d15 and d16 is larger than a spacing 136 between the axis of rotation d16 and the upper carrier 7*a*. There is a horizontal spacing Δx and vertical spacing Δy between the parallel axes of rotation d15 and d16. Rather than being restricted to exemplary embodiments, which have been illustrated or described, the invention also covers developments within the context of the claims. Plastic in particular is provided as the material for the carrying arm.

List of Designations

1 Seating arrangement
2 Office chair
3 Substructure of 1
4 Seat
5 Castor
6 Pneumatic damper
7 First carrying arm
7*a* Upper, first carrier of 7
7*b* Lower, second carrier of 7
7*c* Horizontal, first leg
7*d* Upwardly directed, second leg
7*e* Front, free end of 7*a*
7*f* Horizontal, first leg of 7*b*
7*g* Upwardly directed, second leg of 7*b*

7*h* Front, free end of 7*b*
8 Carrying arm
8*a* Upper, first carrier of 8
8*b* Lower, second carrier of 8
9 Seat shell
10 Seat surface
11 Backrest
12 Transverse carrier between 7 and 8
13 Transverse carrier between 7 and 8
14 Mechanical linking member
15 First bearing, first location
15*a* Strut
16 Second bearing, second location
16*a* Strut
17 Head plate of 6
18 Connecting location, third location
19 First transition region
20*a* Crosspiece
20*b* Film hinge
21 Tunnel
22 Plate
22*a* (Mutually) opposite longitudinal sides of 22
22*b* (Mutually) opposite longitudinal sides of 22
23*a* Undercut groove on 7*a* and 7*b*
23*b* Undercut groove on 7*a* and 7*b*
24 Inner side of 7*a*
25 Inner side of 7*b*
26*a* Sub-plate of 22
26*b* Sub-plate of 22
27*a* Screw between 7*a* and 7*b*
27*b* Screw between 7*a* and 7*b*
28 Clamp
28*a* Jaw of 28
28*b* Jaw of 28
28*c* Crosspiece of 28
29 Outer side of 7*b*
30*a* Carrier half of 7*a*
30*b* Carrier half of 7*a*
31 Pin
32 Extension
33 Front side of 7*b*
34 Rear side of 7*b*
35 Bolt
36 Slot in 7*b*
37 Padding means
38 Headrest
39 Second transition region
40 Link plate
41 Elastic body
42 Rotary bearing
43 Axis of rotation of 16
44 Spring element
45 Pin
46 Axis of rotation of 15
47 Eccentric shaft
48 Axis of rotation of 47
49 Plane
50 Bench
51 Column
52 Chair
53 Cover
100 Carrying arm
101 Left-hand upper carrier of 100
101*a* Upwardly directed leg of 101
102 Right-hand upper carrier of 100
102*a* Upwardly directed leg of 102
103 Lower carrier
103*a* Upwardly directed leg of 103
103*b* Strut of 103*a*
103*c* Strut of 103*a*
103*d* Horizontal leg of 103
104 Linking member between 103 and 101
105 Linking member between 103 and 102
106 Transverse carrier between 101 and 102
107 Transverse carrier between 101 and 102
108 Upper part of 3
109 Central part of 3
110 Lower part of 3
111 Height-adjustable spring element
111*a* Pneumatic spring
111*b* Piston rod of 111*a*
111*c* Pressure tube of 111*a*
112 Vertical axis of rotation
113 Seat height of 1
114 Spring element beneath 111*a*
115 Helical spring
116 Spring mechanism
117 Spring element
118 Flange plate on 111*b*
119 Weighing mechanism
120 Wire of 121
121 Bowden cable
122 Bearing means for 123
123 Leaf spring
124 Hose of 121
125 Protrusion on 7*a*
126 Second Bowden cable
127 Spring element on 122
128 First lever between 108 and 7*a*
129 Second lever between 108 and 7*a*
130 Four-bar linkage
131 Coupling mechanism
132 Toggle
132*a* Upper lever of 132
132*b* Lower lever of 132
133 Spring between d132 and 108
134 Stop
135 Spacing between d15 and d16
136 Spacing between d16 and 7*a*
I-V Section
α Opening angle between seat surface 10 and backrest 11
β Angle giving the inclination of the seat surface 10
γ Angle giving the inclination of the backrest 11
A First or non-loaded position of the seating arrangement
A7 Vertical axis
B-D Intermediate positions of the seating arrangement
E Second position or end position of the seating arrangement
F Force
G Weight
K Curve formed by 7*a*
K7*c* Orbit around d15 by R7*c*
K7*f* Orbit around d16 by R7*f*
M Moment
N Body between 7*a* and 7*b*
P Individual
R Radius of 7*b* at 19
R7*c* Reference point on 7*c*
R7*f* Reference point on 7*f*
T Torsion spring
a Spacing between 14
b Width of 7
d15 Axis of rotation of 15
d16 Axis of rotation of 16
d132 Axis of rotation between 132*a* and 132*b* r Radius of 7*a* at 19
w Direction of rotation of 7
Δx Horizontal spacing between d15 and 16
Δy Vertical spacing between d15 and 16

The invention claimed is:

1. A seating arrangement comprising:

a seat and a substructure, wherein the seat comprises a pair of carrying arms arranged in a mirror-symmetrical manner in relation to a vertical plane which divides the seating arrangement in a mirror-symmetrical manner, each of the carrying arms comprises at least one upper, first carrier and at least one lower, second carrier, in a first position of the seating arrangement, the upper, first carrier of each carrying arm has an approximately horizontal, first leg and an upwardly directed, second leg, in the region of a front end of the first leg of each of the upper, first carriers, the upper, first carrier is supported by the substructure at a first location on the upper, first carrier, in the first position of the seating arrangement, the lower, second carrier of each carrying arm has an approximately horizontal, first leg and an upwardly directed, second leg, in the region of a front end of the first leg of each of the lower, second carriers, the lower, second carrier is supported by the substructure at a second location on the lower, second carrier spaced from the first location, the second leg of the upper, first carrier and the second leg of the lower, second carrier of each respective carrying arm are connected to one another at a third location, between the third location and the first and second locations, the upper, first carrier and the lower, second carrier are kept at a defined spacing from one another in at least one section by at least one mechanical linking member, wherein the at least one linking member connecting the upper, first and the lower, second carriers is located in a first transition region, in which the horizontal, first legs merge into the upwardly directed, second legs.

2. The seating arrangement according to claim 1, characterized in that the upper, first and the lower, second carriers of each carrying arm can be elastically deformed.

3. The seating arrangement according to claim 1, characterized in that each of the upper, first carriers is formed in one piece.

4. The seating arrangement according to claim 1, characterized in that each of the lower, second carriers is formed in one piece.

5. The seating arrangement according to claim 1, characterized in that at least two linking members are arranged between the upper, first and lower, second carriers of each of the carrying arms.

6. The seating arrangement according to claim 1, characterized in that at least two linking members are arranged in the first transition region.

7. The seating arrangement according to claim 1, characterized in that the first transition region extends over half the length of a seat surface and half the height of a backrest.

8. The seating arrangement according to claim 1, characterized in that at least two linking members are arranged in a second transition region between the upwardly directed, second legs of the upper, first and lower, second carriers of each of the carrying arms.

9. The seating arrangement according to claim 1, characterized in that, in the first position of the seating arrangement, the first and second legs of each of the upper, first carriers enclose an opening angle of approximately 85° to 110°.

10. The seating arrangement according to claim 1, characterized in that, in a second position of the seating arrangement, the first and second legs of each of the upper first carriers enclose an opening angle of more than 100°.

11. The seating arrangement according to claim 1, characterized in that the upper, first carrier and the lower, second carrier of each of the carrying arms form a single-piece component.

12. The seating arrangement according to claim 1, characterized in that the upper, first carrier, the lower, second carrier and the linking member of each of the carrying arms form a single-piece component.

13. The seating arrangement according to claim 1, characterized in that the upper, first carrier of each carrying arm is connected to the substructure in a rotatable manner via at least one lever.

14. The seating arrangement according to claim 13, characterized in that the upper, first carrier of each carrying arm is connected to the substructure via a coupling mechanism.

15. The seating arrangement according to claim 1, characterized in that the pair of carrying arms is formed by a left-hand upper carrier and a right-hand upper carrier and a lower carrier located between the two, the lower carrier being connected to the left-hand upper carrier by mechanical linking members, and the lower carrier being connected to the right-hand upper carrier by mechanical linking members.

16. The seating arrangement according to claim 15, characterized in that an upwardly directed leg of the lower carrier is divided into two struts and merges, by way of these struts, into upwardly directed legs of the upper carriers.

17. The seating arrangement according to claim 15, characterized in that the pair of carrying arms is formed in one piece.

18. The seating arrangement according to claim 1, characterized in that the upper, first carriers form a seat surface and/or a backrest.

19. The seating arrangement according to claim 1, characterized in that the upper, first carriers bear a seat surface and/or a backrest.

20. The seating arrangement according to claim 1, characterized in that a seat surface and/or a backrest are/is formed by a cover, the cover connecting the pair of carrying arms to one another.

21. The seating arrangement according to claim 1, characterized in that the upper, first carrier and/or the lower, second carrier of the carrying arms are/is supported by a spring element or a spring mechanism against an inclining movement in a direction of rotation.

22. The seating arrangement according to claim 1, characterized in that the horizontal, first leg of the upper, first carrier of each of the carrying arms and the horizontal, first leg of the lower, second carrier of each of the carrying arms are displaced in relation to one another when the seat is subjected to loading and the carrying arms are rotated correspondingly.

23. The seating arrangement according to claim 1, characterized in that the axis of rotation of the upper, first carrier of each of the carrying arms and the axis of rotation of the lower, second carrier of each of the carrying arms are spaced apart from one another, the axes of rotation running parallel to one another, the axis of rotation of the lower, second carrier being located vertically above the axis of rotation of the upper, first carrier, and the axis of rotation of the lower, second carrier being offset in the horizontal direction in relation to the axis of rotation of the upper, first carrier.

24. The seating arrangement according to claim 23, characterized in that the spacing between the axis of rotation of the upper, first carrier and the axis of rotation of the lower, second carrier of each carrying arm is larger than a spacing between the axis of rotation of the lower, second carrier and the upper, first carrier.

25. The seating arrangement of claim 1 wherein the upper, first carrier of each of the carrying arms is pivotally coupled to the substructure at the first location.

26. The seating arrangement of claim 1 wherein the lower, second carrier of each carrying arm is pivotally coupled to the substructure at the second location.

27. A seating arrangement comprising:

a seat and a substructure, wherein the seat comprises at least one carrying arm, the carrying arm comprises at least one upper, first carrier and at least one lower, second carrier, in a first position of the seating arrangement, the upper, first carrier has an approximately horizontal, first leg and an upwardly directed, second leg, in the region of a front end of the first leg of the upper, first carrier, the first carrier is supported by the substructure at a first location on the first carrier, in the first position of the seating arrangement, the lower, second carrier has an approximately horizontal, first leg and an upwardly directed, second leg, in the region of a front end of the first leg of the lower, second carrier, the lower, second carrier is supported by the substructure at a second location on the second carrier spaced from the first location, the second leg of the upper, first carrier and the second leg of the lower, second carrier are connected to one another at a third location, between the third location and the first and second locations, the upper, first carrier and the lower, second carrier are kept at a defined spacing from one another in at least one section by at least one mechanical linking member, wherein the upper, first carrier and the lower, second carrier are spaced apart within a vertically oriented plane, and wherein the at least one linking member connecting the upper, first and the lower, second carriers is located in a first transition region, in which the horizontal, first legs merge into the upwardly directed, second legs.

28. A seating arrangement comprising:

a seat and a substructure, wherein the seat comprises at least one carrying arm, the carrying arm comprises at least one upper, first carrier and at least one lower, second carrier, in a first position of the seating arrangement, the upper, first carrier has an approximately horizontal, first leg and an upwardly directed, second leg, in the region of a front end of the first leg of the upper, first carrier, the first carrier is supported by the substructure at a first location on the first carrier, in the first position of the seating arrangement, the lower, second carrier has an approximately horizontal, first leg and an upwardly directed, second leg, in the region of a front end of the first leg of the lower, second carrier, the lower, second carrier is supported by the substructure at a second location on the second carrier spaced from the first location, the second leg of the upper, first carrier and the second leg of the lower, second carrier are connected to one another at a third location, between the third location and the first and second locations, the upper, first carrier and the lower, second carrier are kept at a defined spacing from one another in at least one section by at least one mechanical linking member, wherein the upper first carrier and the lower second carrier each experience bending when the seat is subjected to rearward tilting, and wherein the at least one linking member connecting the upper, first and the lower, second carriers is located in a first transition region, in which the horizontal, first legs merge into the upwardly directed, second legs.

29. A seating arrangement comprising:

a seat and a substructure, wherein the seat comprises at least one carrying arm, the carrying arm comprises at least one upper, first carrier and at least one lower, second carrier, in a first position of the seating arrangement, the upper, first carrier has an approximately horizontal, first leg and an upwardly directed, second leg, in the region of a front end of the first leg of the upper, first carrier, the first carrier is pivotally coupled to the substructure at a first location on the first carrier with a lever, wherein the lever extends between the upper first carrier and the substructure, in the first position of the seating arrangement, the lower, second carrier has an approximately horizontal, first leg and an upwardly directed, second leg, in the region of a front end of the first leg of the lower, second carrier, the lower, second carrier is supported by the substructure at a second location on the second carrier spaced from the first location, the second leg of the upper, first carrier and the second leg of the lower, second carrier are connected to one another at a third location, between the third location and the first and second locations, the upper, first carrier and the lower, second carrier are kept at a defined spacing from one another in at least one section by at least one mechanical linking member, wherein the at least one linking member connecting the upper, first and the lower, second carriers is located in a first transition region, in which the horizontal, first legs merge into the upwardly directed, second legs.

30. The seating arrangement of claim 29 further comprising a second lever pivotally connected to the upper, first carrier at a third location, wherein the second lever extends between the upper, first carrier and the lower, second carrier.

31. The seating arrangement of claim 30 wherein the second lever is pivotally connected to the substructure.

* * * * *